US010367248B2

(12) United States Patent
Toyao et al.

(10) Patent No.: US 10,367,248 B2
(45) Date of Patent: Jul. 30, 2019

(54) ANTENNA, ARRAY ANTENNA, AND RADIO COMMUNICATION APPARATUS

(71) Applicant: NEC Corporation, Tokyo (JP)

(72) Inventors: Hiroshi Toyao, Tokyo (JP); Keishi Kosaka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 15/129,519

(22) PCT Filed: Mar. 17, 2015

(86) PCT No.: PCT/JP2015/001473

§ 371 (c)(1),
(2) Date: Sep. 27, 2016

(87) PCT Pub. No.: WO2015/151430

PCT Pub. Date: Oct. 8, 2015

(65) Prior Publication Data

US 2017/0117612 A1 Apr. 27, 2017

(30) Foreign Application Priority Data

Mar. 31, 2014 (JP) ..... 2014-073196

(51) Int. Cl.
*H01Q 1/24* (2006.01)
*H01Q 1/36* (2006.01)
(Continued)

(52) U.S. Cl.
CPC ..... *H01Q 1/24* (2013.01); *H01Q 1/36* (2013.01); *H01Q 1/38* (2013.01); *H01Q 9/265* (2013.01);
(Continued)

(58) Field of Classification Search
CPC ..... H01Q 1/38; H01Q 9/265; H01Q 19/10; H01Q 19/108; H01Q 9/18; H01Q 7/00;
(Continued)

(56) References Cited

U.S. PATENT DOCUMENTS 9,172,147 B1 * 10/2015 Manry, Jr. ..... H01Q 1/286
2004/0021463 A1 * 2/2004 Miyazawa ..... G01R 29/0878 324/252

(Continued)

FOREIGN PATENT DOCUMENTS

EP 2629366 A1 8/2013
EP 2750249 * 2/2014 ..... H01Q 13/16

(Continued)

OTHER PUBLICATIONS

Mikko Karkkainen et al., "Patch Antenna With Stacked Split-Ring Resonators as an Artificial Magneto-Dielectric Substrate," Microwave and Optical Technology Letters, vol. 46, No. 6, Sep. 20, 2005, pp. 554-556.

(Continued)

*Primary Examiner* — Ricardo I Magallanes
(74) *Attorney, Agent, or Firm* — Wilmer Cutler Pickering Hale and Dorr LLP

(57) ABSTRACT

An antenna according to one exemplary aspect of the present invention includes an antenna element and a reflector conductor that is arranged to be spaced apart from the antenna element. The antenna element includes a first split-ring conductor having such a shape that a part of a ring is cut by a split part, a first connection conductor having one end that is electrically connected to the first split-ring conductor and another end that is electrically connected to the reflector conductor, and a feed line conductor having one end that is electrically connected to the first split-ring conductor. The feed line conductor spans an opening that is formed inside the first split-ring conductor and overlaps an area surrounded by an outer edge of the first connection conductor.

10 Claims, 29 Drawing Sheets

(51) Int. Cl.

| | |
|---|---|
| ***H01Q 1/38*** | (2006.01) |
| ***H01Q 9/26*** | (2006.01) |
| ***H01Q 9/42*** | (2006.01) |
| ***H01Q 15/14*** | (2006.01) |
| ***H01Q 19/10*** | (2006.01) |
| ***H01Q 21/30*** | (2006.01) |

(52) U.S. Cl.
CPC ..... *H01Q 9/42* (2013.01); *H01Q 15/14* (2013.01); *H01Q 19/10* (2013.01); *H01Q 21/30* (2013.01)

(58) Field of Classification Search
CPC ..... H01Q 13/10; H01Q 9/0464; H01Q 9/32; G01R 29/0878
See application file for complete search history.

(56) References Cited

U.S. PATENT DOCUMENTS

| | | | |
|---|---|---|---|
| 2013/0002490 | A1 | 1/2013 | Liu et al. |
| 2014/0203993 | A1 | 7/2014 | Toyao |

FOREIGN PATENT DOCUMENTS

| | | | |
|---|---|---|---|
| EP | 2750249 | A1 | 7/2014 |
| JP | 2003-114265 | A | 4/2003 |
| JP | 2006-222873 | A | 8/2006 |
| JP | 2011-254482 | A | 12/2011 |
| JP | 2013183204 | A | 9/2013 |
| WO | WO-2013-027824 | A1 | 2/2013 |

OTHER PUBLICATIONS

In Kwang Kim et al., Electrically Small, Millimeter Wave Dual Band Meta-Resonator Antennas, IEEE Transactions on Antennas and Propagation, vol. 58, Issue 11, Nov. 2010, pp. 3458-3463.
International Search Report corresponding to PCT/JP2015/001473 dated Apr. 14, 2015 (5 pages).
Decision to Grant a Patent issued by the Japan Patent Office for Japanese Application No. 2016-511359 dated Sep. 25, 2018 (6 pages).

* cited by examiner

ANTENNA, ARRAY ANTENNA, AND RADIO COMMUNICATION APPARATUS

CROSS-REFERENCE TO RELATED APPLICATIONS

This application is a national stage application of International Application No. PCT/JP2015/001473 entitled "ANTENNA, ARRAY ANTENNA, AND RADIO COMMUNICATION APPARATUS," filed on Mar. 17, 2015, which claims the benefit of the priority of Japanese Patent Application No. 2014-073196 filed on Mar. 31, 2014, the disclosures of each of which are hereby incorporated by reference in their entirety.

TECHNICAL FIELD

The present invention relates to an antenna, an array antenna, and a radio communication apparatus.

BACKGROUND ART

In order to deal with a recent sharp increase in an amount of radio communication, use of a Multi Input Multi Output (MIMO) communication system in which a plurality of antennas are concurrently used, beam forming by an array antenna in which a plurality of antennas are arranged and the like has been advancing and the number of antennas mounted on a radio communication apparatus has tended to increase. It is therefore strongly required that both a decrease in the size of the antenna mounted on the radio communication apparatus and a reduction in the cost of the antenna be achieved.

A dipole antenna which has high radiation efficiency and is capable of radiating radio waves in a wide range of directions and a patch antenna that can be formed to be thin are well known as two of the most common antennas. However, it is difficult to reduce the respective sizes of these antennas since they each need to have a size of a half of the wavelength in principle.

Patent Literature 1 discloses a technique for reducing the size of an antenna by adding a parasitic element, a part of which is formed of magnetic materials, to a dipole antenna. In Patent Literature 1, by controlling the distribution of magnetic field lines in the vicinity of the antenna using magnetic materials, it is possible to reduce the size of the antenna and perform impedance matching without using a matching circuit.

Further, Non-Patent Literature 1 discloses a technique for arranging multiple artificial magnetic elements called split-ring resonators inside a patch antenna. By increasing the effective permeability inside the patch antenna by the split-ring resonators, it is possible to shorten the wavelength and to reduce the size of the antenna.

CITATION LIST

Patent Literature

[Patent Literature 1] Japanese Unexamined Patent Application Publication No. 2006-222873

Non Patent Literature

[Non-Patent Literature 1] "Patch Antenna With Stacked Split-Ring Resonators As An Artificial Magneto-Dielectric Substrate," Microwave and Optical Technology Letters, Vol. 46, No. 6, Sep. 20, 2005

SUMMARY OF INVENTION

Technical Problem

However, the antenna disclosed in Patent Literature 1 requires relatively expensive magnetic materials, which increases the cost for manufacturing the antenna.

Further, while the size of the antenna disclosed in Non-Patent Literature 1 can be reduced without using special materials, since the loss of each of the multiple split-ring resonators arranged inside the antenna cannot be negligible in the vicinity of an operating frequency (resonance frequency) of the antenna, the radiation efficiency of the whole antenna is reduced.

The present invention has been made in view of the aforementioned circumstances. One exemplary object of the present invention is to provide an antenna that can be manufactured at a low cost without using special materials and is small, yet still capable of having an excellent antenna performance (high radiation efficiency), an array antenna in which this antenna is arranged, and a radio communication apparatus including the antenna.

Solution to Problem

An antenna according to one exemplary aspect of the present invention includes:

an antenna element; and a reflector conductor that is arranged to be spaced apart from an antenna element, in which:

the antenna element comprises:

- a first split-ring conductor having such a shape that a part of a ring is cut by a split part;
- a first connection conductor having one end that is electrically connected to the first split-ring conductor and another end that is electrically connected to the reflector conductor; and
- a feed line conductor having one end that is electrically connected to the first split-ring conductor, and the feed line conductor spans an opening that is formed inside the first split-ring conductor and overlaps an area surrounded by an outer edge of the first connection conductor.

Advantageous Effects of Invention

According to the present invention, it is possible to provide an antenna that can be manufactured at a low cost without using special materials and is small, yet still capable of having an excellent antenna performance (high radiation efficiency), an array antenna in which this antenna is arranged, and a radio communication apparatus including the antenna.

DESCRIPTION OF EMBODIMENTS

Hereinafter, with reference to the drawings, exemplary embodiments of the present invention will be described. Throughout the drawings, the same and similar components are denoted by the same reference symbols and overlapping descriptions will be omitted.

First Exemplary Embodiment

Figure 1:
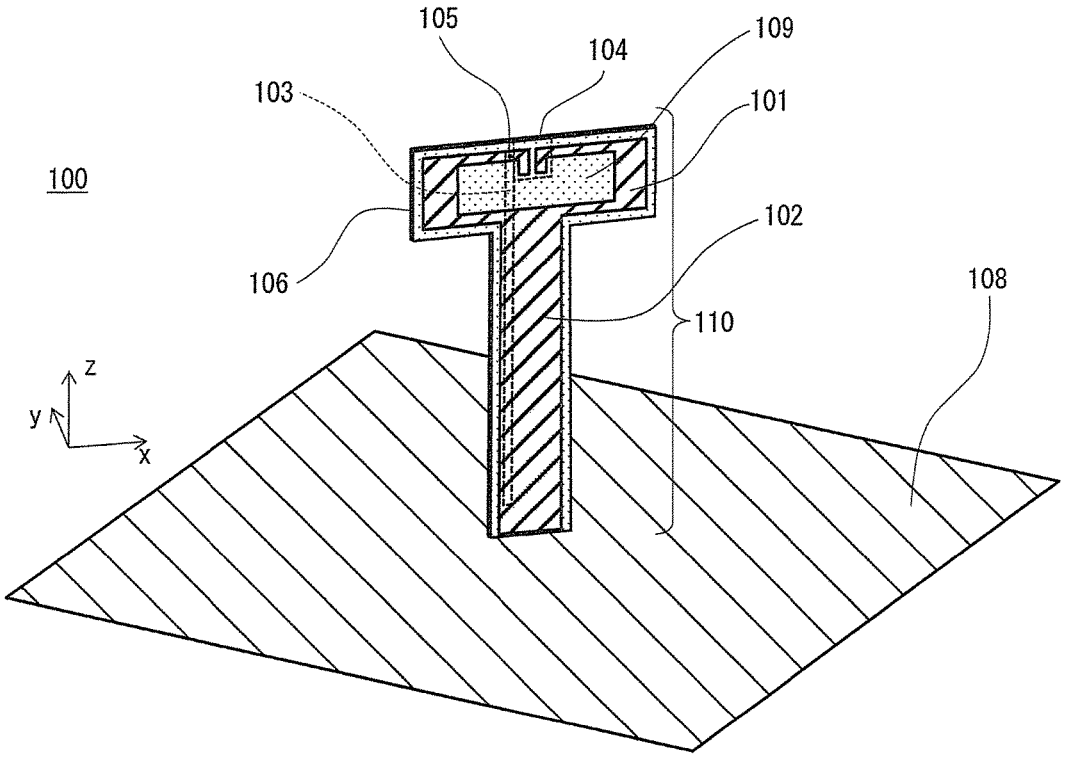
FIG. 1 is a perspective view of an antenna according to a first exemplary embodiment.
Figure 2:
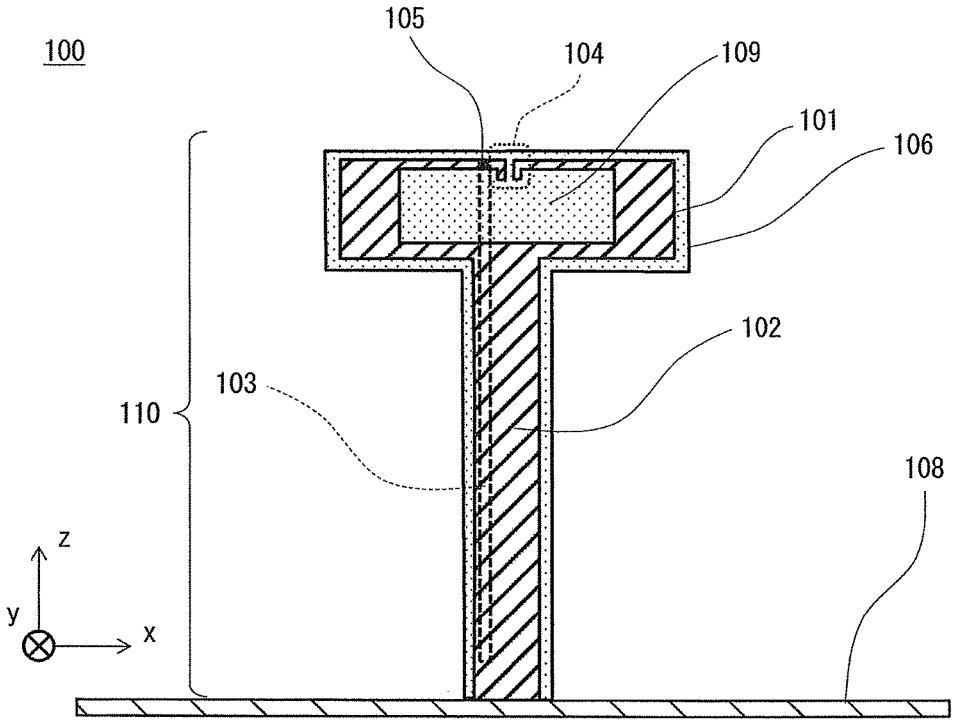
FIG. 2 is a plan view of the antenna shown in FIG. 1 when it is seen from a y-axis negative direction.
Figure 3:
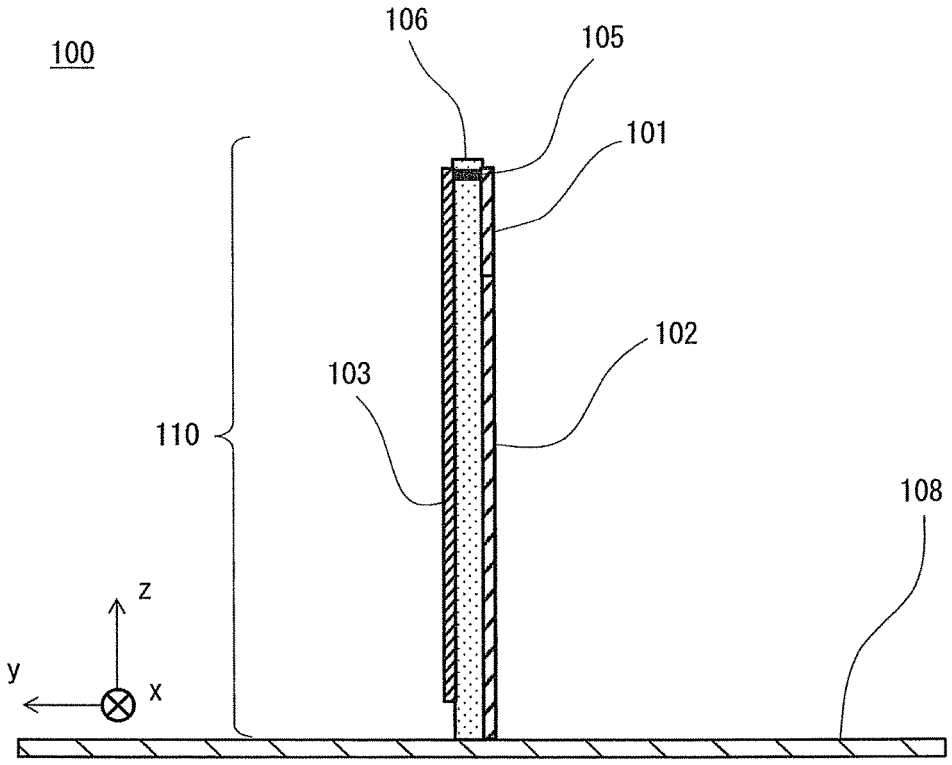
FIG. 3 is a plan view of the antenna shown in FIG. 1 when it is seen from an x-axis negative direction.
Figure 4:
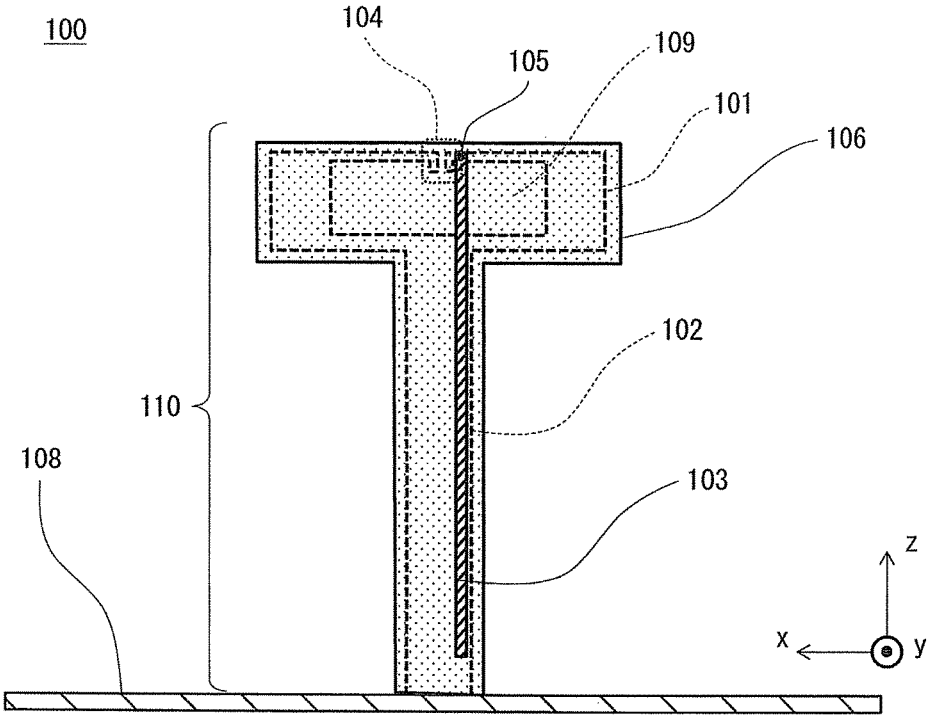
FIG. 4 is a plan view of the antenna shown in FIG. 1 when it is seen from a y-axis positive direction.

FIG. 1 is a perspective view showing one example of an antenna 100 according to a first exemplary embodiment of the present invention. FIGS. 2, 3, and 4 are plan views of the antenna 100 shown in FIG. 1 when it is seen from a y-axis negative direction, an x-axis negative direction, and a y-axis positive direction, respectively.

The antenna 100 includes an antenna element 110 arranged substantially in parallel with the xz-plane and a conductive reflector 108 arranged substantially in parallel with the xy-plane.

The antenna element 110 includes a dielectric substrate 106, a split-ring part 101 and a connection part 102 arranged on the front layer of the dielectric substrate 106 (front surface on the side of the y-axis negative direction), a feed line 103 arranged on the rear layer of the dielectric substrate 106 (front surface on the side of the y-axis positive direction), and a conductor via 105 that connects different layers of the dielectric substrate 106.

The split-ring part 101 is a substantially C-shaped conductor in which a part of the periphery of a rectangular ring having a longer side in the x-axis direction is cut by a split part 104. The split part 104 is provided near the center of the longer side of the split-ring part 101 which is far from the reflector 108 (side of the z-axis positive direction).

The connection part 102 is a conductor that extends in the z-axis direction, and has one end that is connected to a part near the center of the longer side of the split-ring part 101 which is close to the reflector 108 (on the side of the z-axis negative direction) and the other end that is connected to the reflector 108. The connection part 102 electrically connects the split-ring part 101 and the reflector 108.

The feed line 103 is a linear conductor and has one end that is connected to a part on the long side of the split-ring part 101 which is far from the reflector 108 (on the side of the z-axis positive direction) via the conductor via 105. The feed line 103 spans the opening 109 of the split-ring part 101 when it is seen from the y-axis direction and extends to an area that is opposed to the connection part 102. That is, the feed line 103 overlaps with an area surrounded by the edges of the connection part 102 when seen from the y-axis direction. The other end of the feed line 103 is connected to an RF circuit (high-frequency circuit) (not shown).

While the split-ring part 101, the connection part 102, and the feed line 103 that compose the antenna element 110 are typically formed of copper foil, they may be formed of another conductive material. They may be formed of the same material or may be formed of materials different from one another.

The dielectric substrate 106 that supports each conductor element of the antenna element 110 may be formed of any material and by any process. The dielectric substrate 106 may be, for example, a printed board using a glass epoxy resin, an interposer substrate such as a Large Scale Integration (LSI), a module substrate using a ceramic material such a Low Temperature Co-fired Ceramics (LTCC), or may of course be a semiconductor substrate such as silicon.

Here, the case in which the antenna element 110 is formed on the dielectric substrate 106 has been described as an example. However, as long as the respective components formed of a conductor are arranged and connected as stated above, it is not required for the space between the respective components to necessarily be filled with a dielectric material. For example, a structure in which the respective components are manufactured from sheet metal and the interval between the respective components is partially supported by a dielectric material support member can also be employed. In this case, the sections other than the dielectric material support member are hollow, and hence the dielectric loss can be further reduced compared to the case in which the dielectric material substrate 106 is used and the radiation efficiency of the antenna 100 can be improved.

Further, although the reflector 108 is typically formed of a sheet metal or a copper foil bonded to the dielectric substrate, it may be formed of any other conductive material.

Further, although the conductor via 105 is typically formed by plating a through-hole that is formed in the dielectric substrate 106 by a drill, it may be of any structure as long as the layers can be electrically connected. The conductor via 105 may also be configured using, for example, a laser via formed by a laser, a copper line or the like.

Next, functions and effects according to this exemplary embodiment will be described.

By using the antenna 100 according to this exemplary embodiment, the split-ring part 101 serves as an LC series resonant circuit (split-ring resonator) in which an inductance generated by an electric current flowing along a ring and a capacitance generated between conductors opposed to each other in the split part 104 are connected to each other in series. A large current flows through the split-ring part 101 near the resonance frequency of the split-ring resonator and a part of the current components contribute to the radiation, whereby the antenna 100 operates as an antenna.

By using the antenna 100 according to this exemplary embodiment, which uses LC resonance in the split-ring resonator, in contrast to the dipole antenna and the patch antenna that use a wavelength resonance, it is possible to reduce the size of the antenna compared to those of conventional antennas.

Furthermore, the present inventors have found that among the current components that flow through the split-ring part 101, current components in the x-axis direction are the components that mainly contribute to radiation. Therefore, in the antenna 100 according to this exemplary embodiment, the split-ring part 101 is formed into a rectangle which is long in the x-axis direction, whereby it is possible to achieve excellent radiation efficiency.

Furthermore, the present inventors have found, as a result of a detailed study of the electrical field distribution of the split-ring part 101 in the resonance mode according to this exemplary embodiment, that a virtual ground plane is formed on the plane that includes the part near the center of the split-ring part 101 in the x-axis direction and is perpendicular to the x axis.

Accordingly, in the antenna 100 according to this exemplary embodiment, the connection part 102 is connected to the part near the center of the split-ring part 101 in the x-axis direction so that the connection part 102 is positioned near the virtual ground plane, whereby it is possible to electrically connect the split-ring part 101 and the reflector 108 without greatly changing the radiation pattern and the radiation efficiency.

The feed line 103 is capacitatively coupled to the connection part 102 and forms a transmission line in an area that is opposed to the connection part 102. As a result, an RF signal generated by the RF circuit (not shown) is transmitted by the feed line 103 and is supplied to the split-ring part 101.

Since a part of electromagnetic waves radiated from the split-ring part 101 is reflected by the reflector 108, the antenna 100 according to this exemplary embodiment has a radiation pattern having directivity in the z-axis positive direction. It is therefore possible to efficiently radiate the electromagnetic waves in a specific direction.

The resonance frequency of the split-ring resonator can be made low by increasing the inductance by making the size of the ring of the split-ring part 101 larger and making the current path longer, or by increasing the capacitance by narrowing the space between the conductors opposed to each other in the split part 104.

Figure 5:
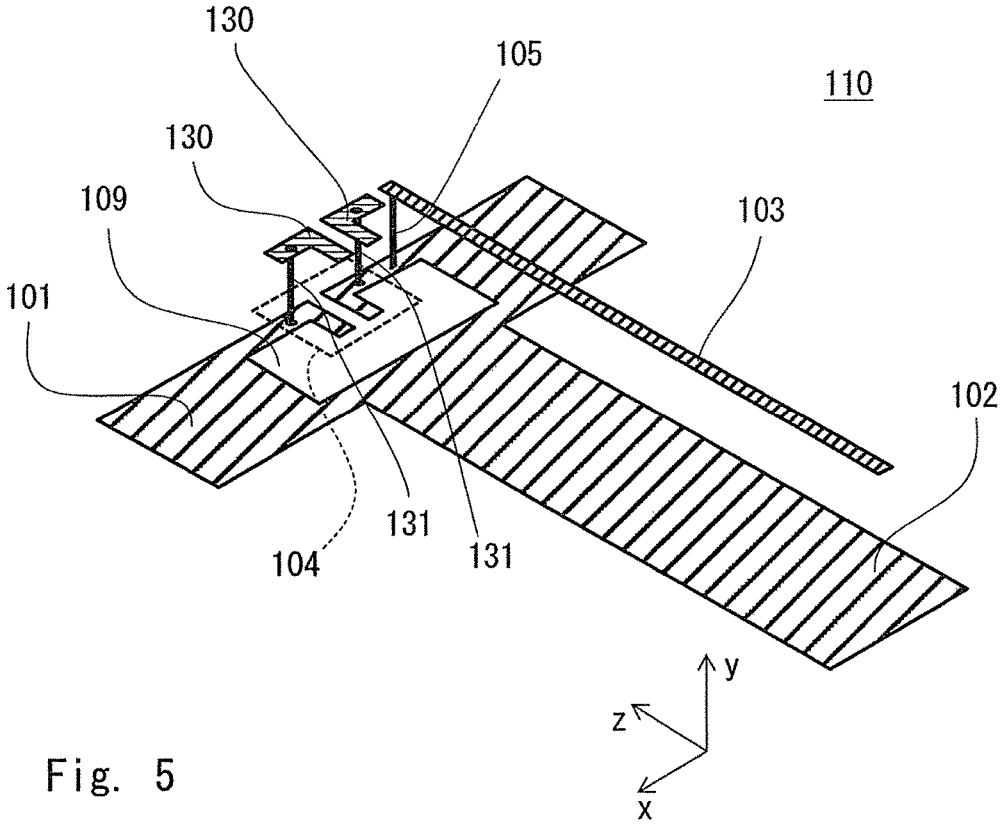
FIG. 5 is a schematic view of another antenna according to the first exemplary embodiment.
Figure 6:
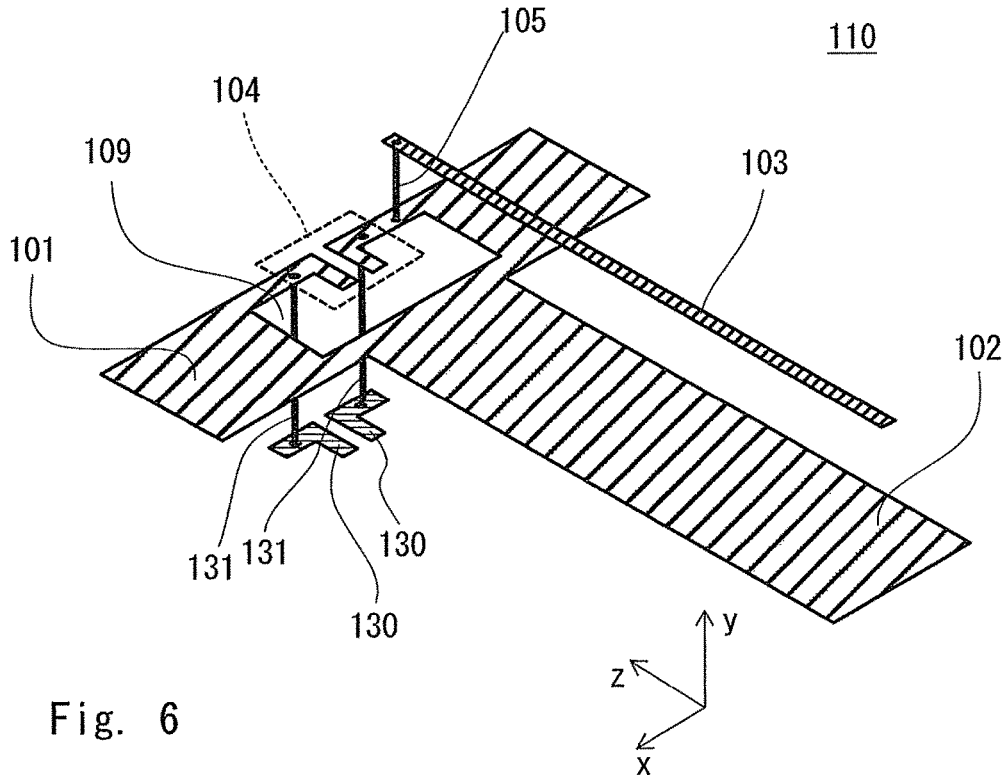
FIG. 6 is a schematic view of another antenna according to the first exemplary embodiment.

One possible method to increase the capacitance is, for example, as shown in FIGS. 5 and 6, to employ a structure in which auxiliary conductor patterns 130 are provided in a layer of the dielectric substrate 106 different from the layer in which the split-ring part 101 is arranged and the auxiliary conductor patterns 130 are electrically connected to the split part 104 by conductor vias 131. The area of the conductors that are opposed to each other in the split part 104 increases due to the arrangement of the auxiliary conductor patterns 130, whereby it is possible to increase the capacitance without increasing the size of the resonator as a whole. FIG. 5 shows an example in which the auxiliary conductor patterns 130 are arranged on a layer the same as the layer on which the feed line 103 is arranged. FIG. 6 shows a case in which the auxiliary conductor patterns 130 are arranged on a layer different from the layer on which the split-ring part 101 is arranged and the layer on which the feed line 103 is arranged.

Figure 7:
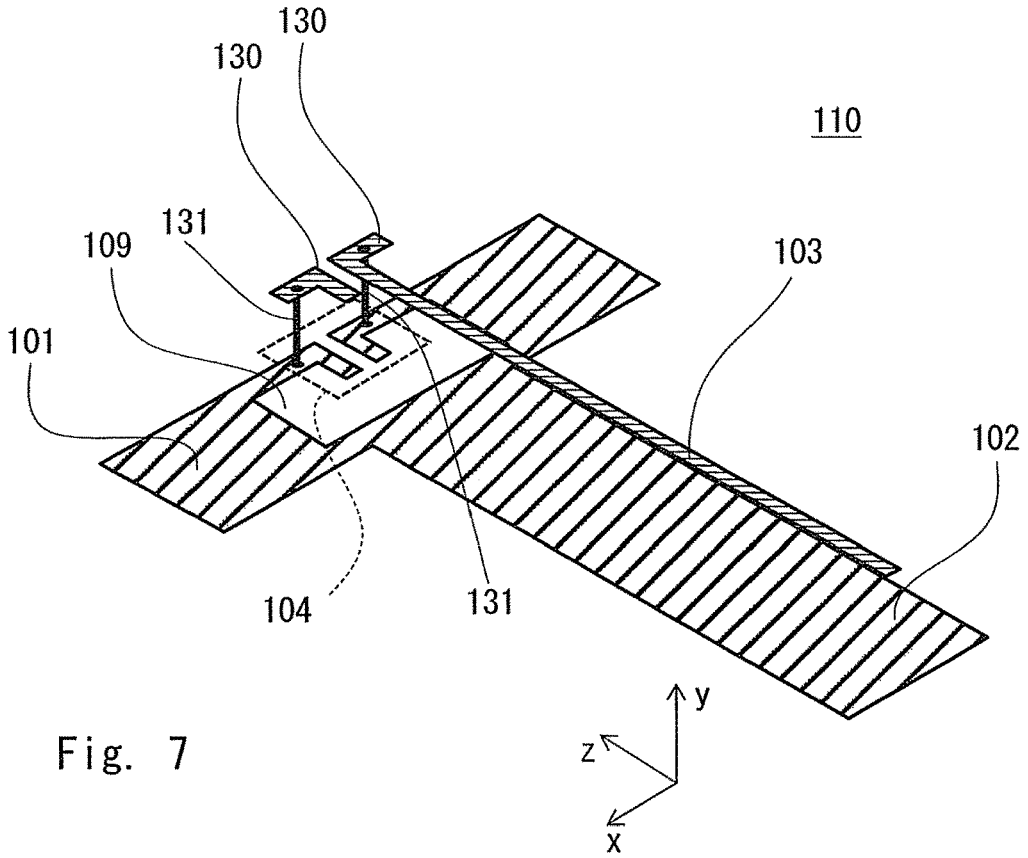
FIG. 7 is a schematic view of another antenna according to the first exemplary embodiment.

Further, as shown in FIG. 7, such a structure in which the feed line 103 is directly connected to the auxiliary conductor pattern 130 in the structure shown in FIG. 5 may be employed. It is therefore possible to omit the conductor via 105 and to simplify the structure.

Figure 8:
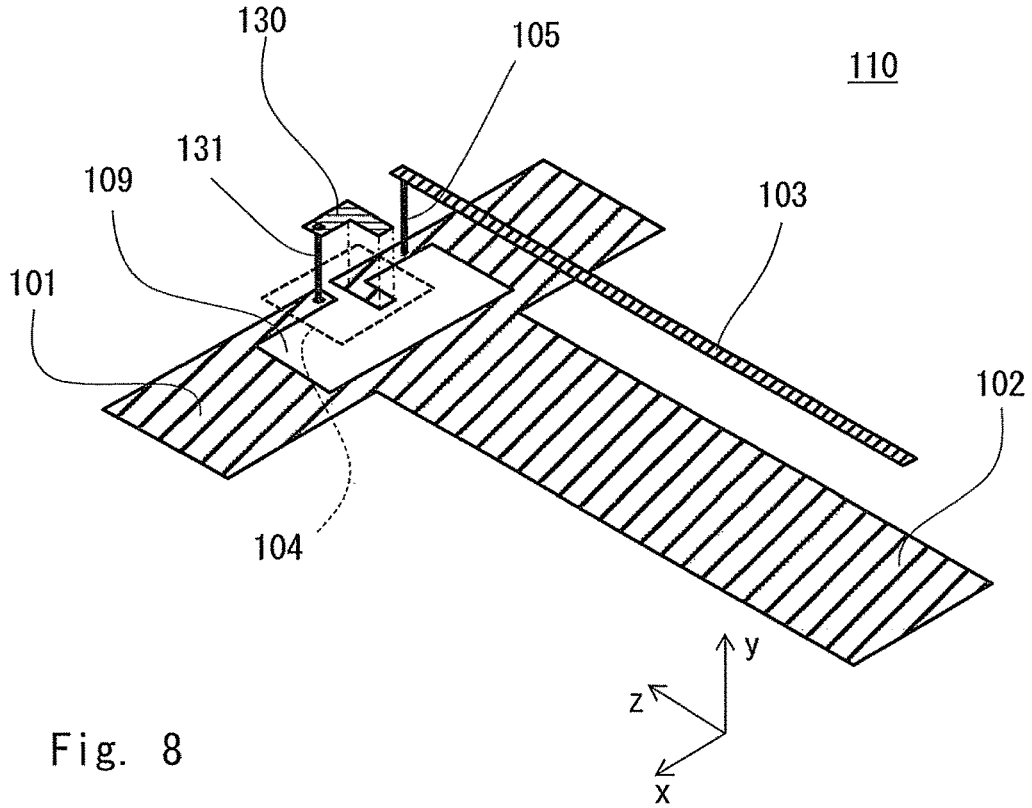
FIG. 8 is a schematic view of another antenna according to the first exemplary embodiment.

Further, as shown in FIG. 8, a structure in which the auxiliary conductor pattern 130 is provided in one conductor of the split part 104 and the auxiliary conductor pattern 130 and at least a part of the other conductor of the split part 104 overlap each other when seen from the y-axis positive direction may be employed. It is therefore possible to further increase the area of the conductors that are opposed to each other, whereby it is possible to increase the capacitance without increasing the size of the resonator as a whole.

Figure 9:
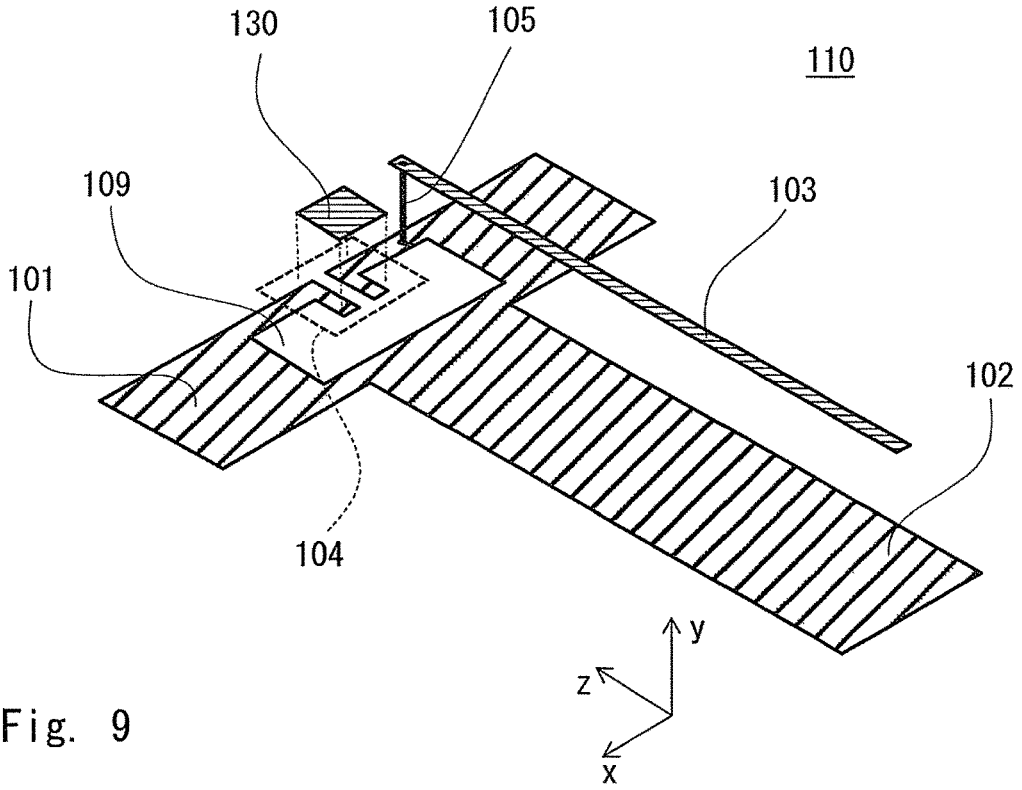
FIG. 9 is a schematic view of another antenna according to the first exemplary embodiment.

Further, as shown in FIG. 9, a structure in which the conductor vias 131 are not provided and both conductors of the auxiliary conductor pattern 130 and the split part 104 overlap each other when seen from the y-axis positive direction may be employed. It is therefore possible to further increase the area of the conductors that are opposed to each other, whereby it is possible to increase the capacitance without increasing the size of the resonator as a whole.

Figure 10:
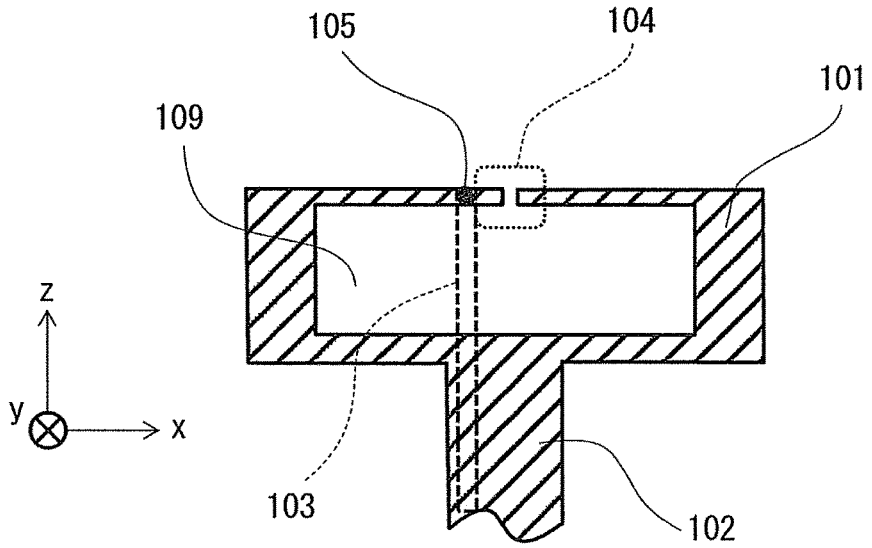
FIG. 10 is a diagram for describing the shape of a split part.

Further, as shown in FIG. 10, it may be possible to decrease the capacitance by decreasing the area of the conductors that are opposed to each other in the split part 104. According to this structure, it is possible to make the resonance frequency of the split-ring resonator be high.

The split-ring part 101 preferably has a longer side in the x-axis direction in order to obtain excellent radiation efficiency as stated above. While the case in which the split-ring part 101 is a rectangle has been described as a representative example, the split-ring part 101 may have another shape as long as it has a longer side in the x-axis direction. Even when the split-ring part 101 has a shape other than a rectangle, this does not change the essential effect of the present invention. The split-ring part 101 may have, for example, an elliptical shape or a bow tie shape.

Figure 11:
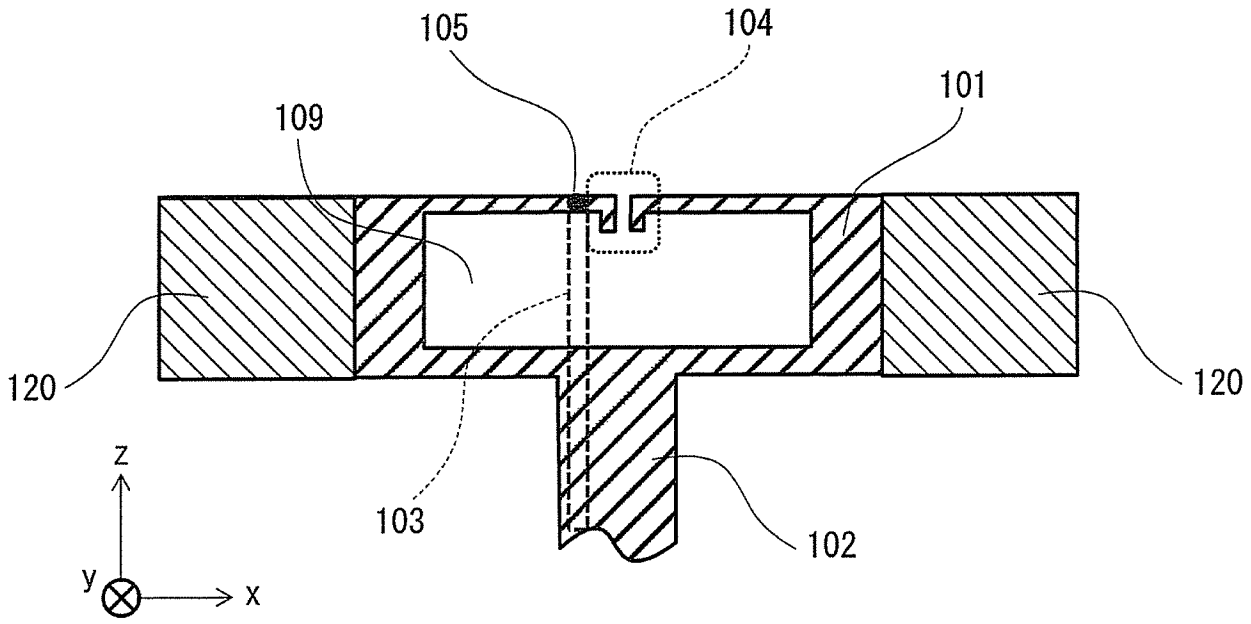
FIG. 11 is a diagram showing a part around a split-ring part in which conductive radiation parts are provided.
Figure 12:
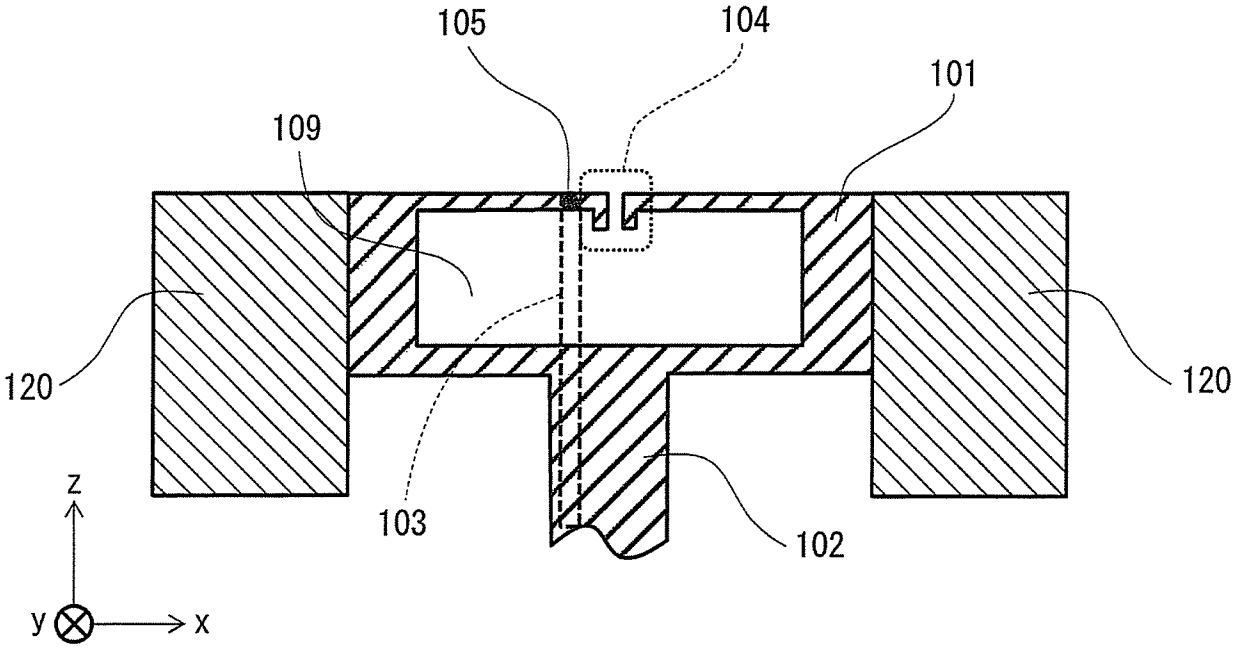
FIG. 12 is a diagram showing a part around the split-ring part in which another conductive radiation parts are provided.
Figure 13:
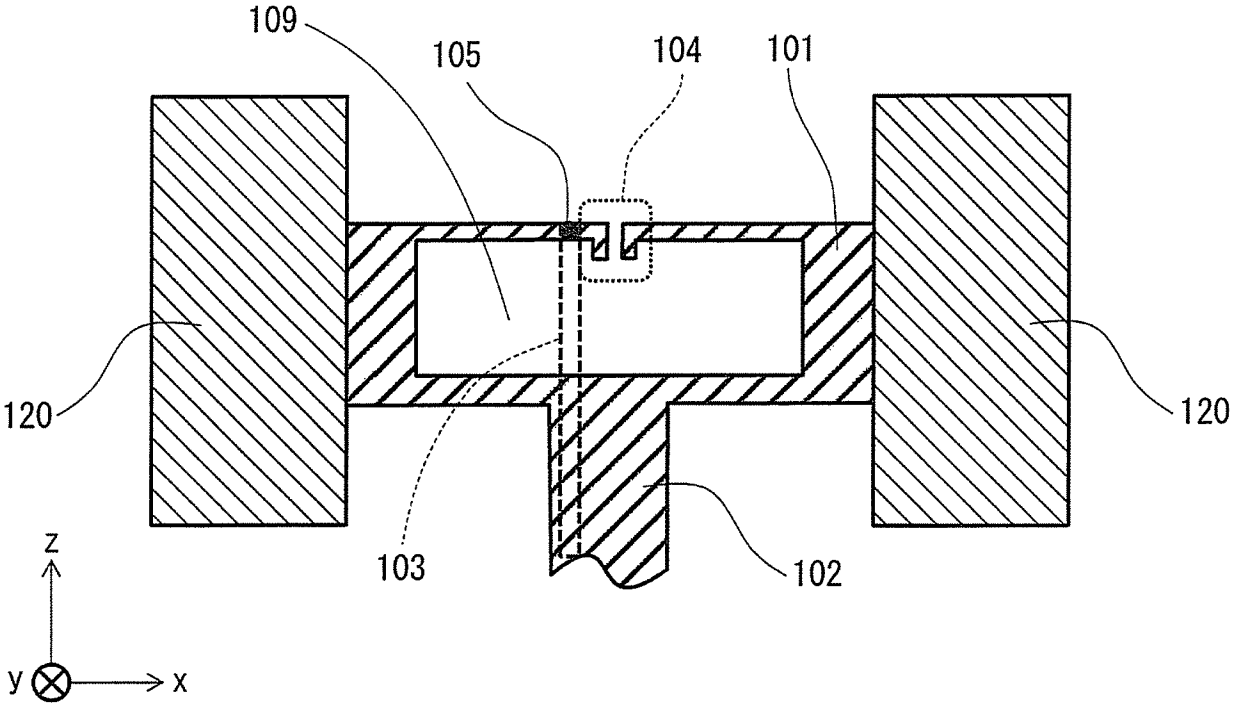
FIG. 13 is a diagram showing a part around the split-ring part in which another conductive radiation parts are provided.
Figure 14:
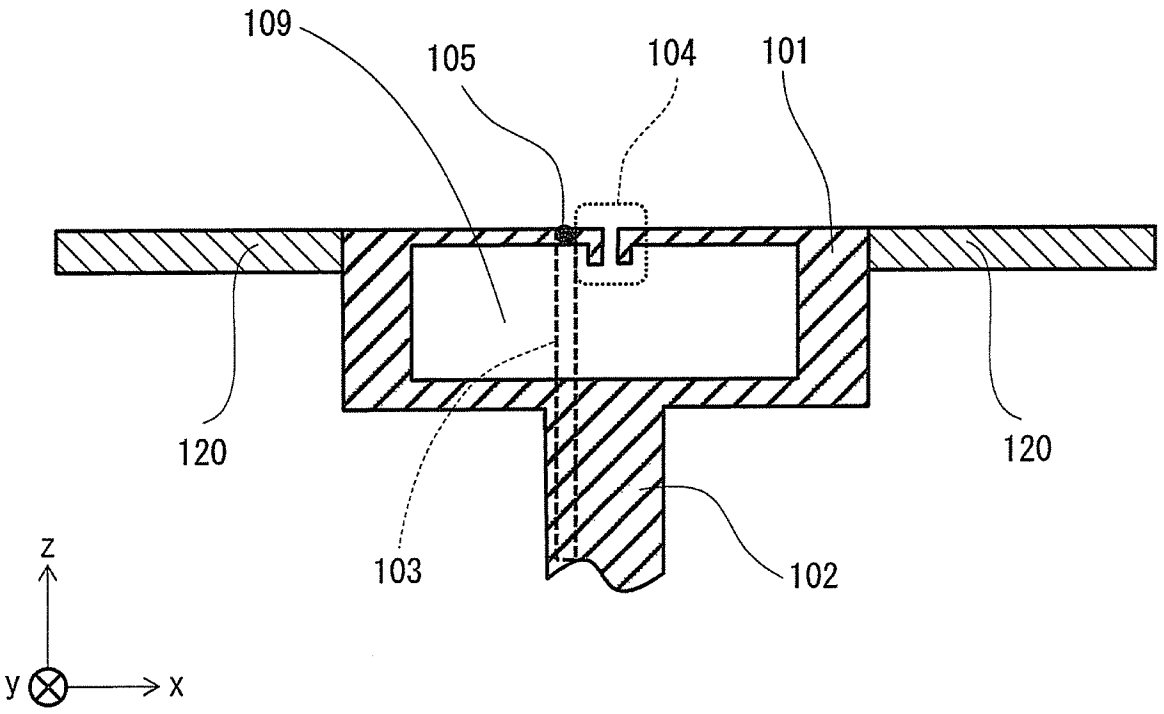
FIG. 14 is a diagram showing a part around the split-ring part in which another conductive radiation parts are provided.

Further, as shown in FIG. 11, a structure in which conductive radiation parts 120 are included on the respective ends of the split-ring part 101 in the x-axis direction may be employed. According to this structure, it is possible to induce the current components in the x-axis direction that contribute to radiation to radiation parts 120, whereby it is possible to improve the radiation efficiency. While the case in which the size of the radiation part 120 in the z-axis direction and the size of the split-ring part 101 in the z-axis direction coincide with each other has been shown in FIG. 11, the shape of the radiation part 120 is not limited to this. As shown in FIGS. 12 and 13, for example, a structure in which the size of the radiation part 120 in the z-axis direction is larger than the size of the split-ring part 101 in the z-axis direction may be employed. Alternatively, as shown in FIG. 14, a structure in which the size of the radiation part 120 in the z-axis direction is smaller than the size of the split-ring part 101 in the z-axis direction may be employed.

Figure 15:
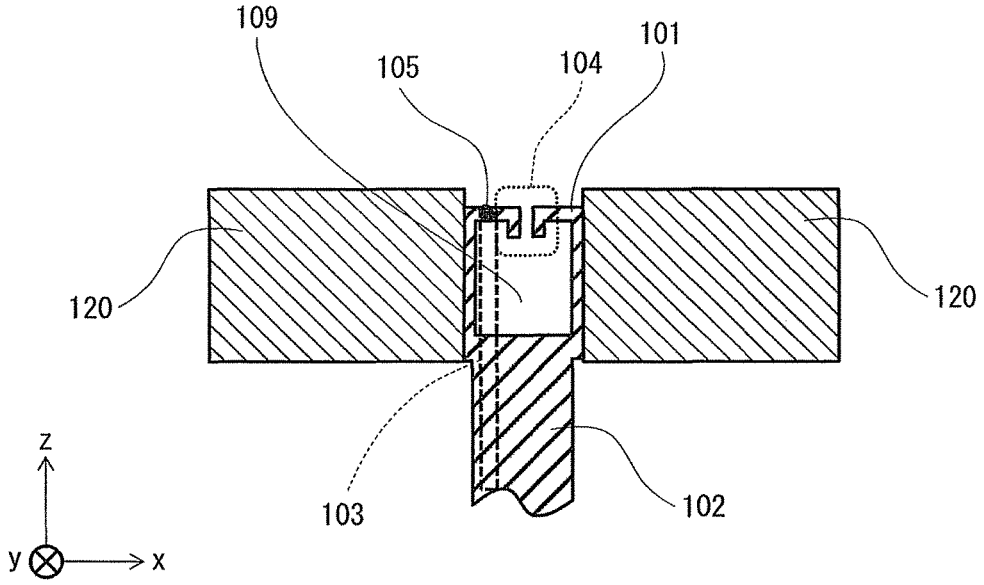
FIG. 15 is a diagram showing a part around another split-ring part in which the conductive radiation parts are provided.

In the structure including the radiation parts 120, it is sufficient that the part which includes the split-ring part 101 and the radiation parts 120 have a longer side in the x-axis direction. Therefore, the split-ring part 101 does not necessarily have a longer side in the x-axis direction. As shown in FIG. 15, for example, the shape of the split-ring part 101 may be a rectangle having a longer side in the z-axis direction or may be a square, a circle, or a triangle.

Further, since the characteristic impedance of the transmission line composed of the feed line 103 and the connection part 102 can be designed by the width of the feed line 103 or the layer spacing between the feed line 103 and the connection part 102, by matching the characteristic impedance of the transmission line with the impedance of the RF circuit, it becomes possible to supply the signal of the RF circuit to the antenna without reflections, and hence this is preferable. However, even in a case where the characteristic impedance of the transmission, line is not matched with the impedance of the RF circuit, this does not change the essential effect of the present invention.

Further, in the antenna element 110 according to this exemplary embodiment, the impedances of the feed line 103 and the split-ring resonator can be matched by changing the connection position between the feed line 103 and the split-ring part 101.

Further, as described above, the connection part 102 is preferably arranged near the virtual ground plane formed on a plane which includes a part near the center of the split-ring part 101 in the x-axis direction and is perpendicular with the x axis along the virtual ground plane. More specifically, the range of one quarter of the length of the split-ring part 101 in the x-axis direction or the length of the part including the split-ring part 101 and the radiation parts 120 in the x-axis direction extending in the x-axis positive direction or the x-axis negative direction from the virtual ground plane can be substantially regarded to be a ground surface. The connection part 102 is preferably located in this area.

Therefore, the length of the connection part 102 in the x-axis direction is preferably equal to or smaller than half of the length of the split-ring part 101 in the x-axis direction or half of the length of the part including the split-ring part 101 and the radiation parts 120 in the x-axis direction. However, even when the connection part 102 is located in an area other than the one stated above, this does not change the essential effect of the present invention. Further, even when the length of the connection part 102 in the x-axis direction is in a range other than the one stated above, this does not change the essential effect of the present invention.

Further, the split-ring part 101 and the reflector 108 are preferably arranged in such a way that they are separated from each other by about one quarter of the wavelength in the z-axis direction. It is therefore preferable that the length of the connection part 102 in the z-axis direction be about one quarter of the wavelength. In this case, the electromagnetic waves radiated from the split-ring part 101 in the z-axis positive direction and the electromagnetic waves radiated in the z-axis negative direction and reflected by the reflector 108 strengthen each other, whereby it is possible to improve the antenna gain in the z-axis positive direction. However, even when the z-direction distance between the split-ring part 101 and the reflector 108 has a value other than one quarter of the wavelength, this does not change the essential effect of the present invention.

Figure 16:
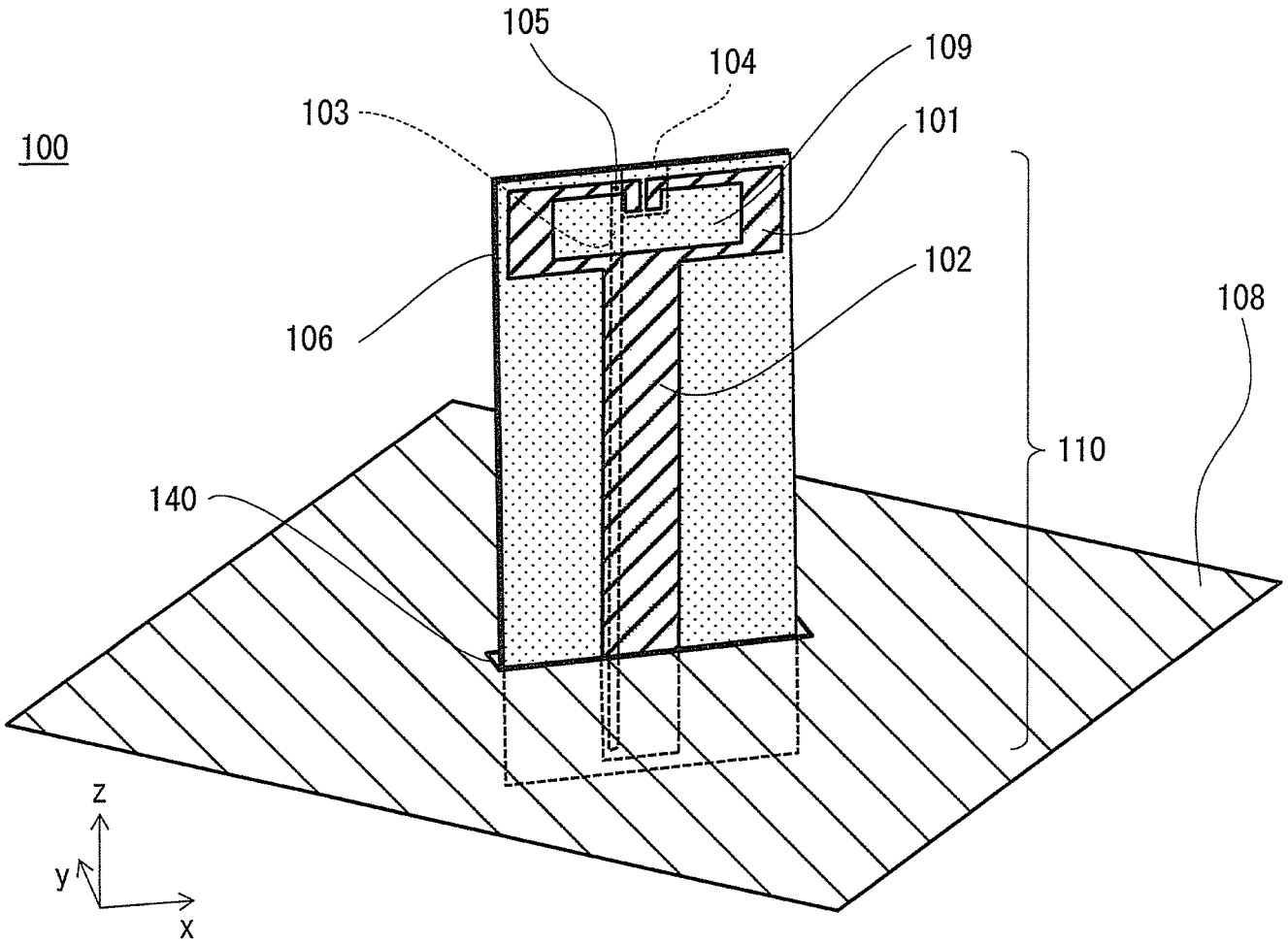
FIG. 16 is a schematic view of another antenna according to the first exemplary embodiment.

Further, as shown in FIG. 16, a structure in which a through-hole 140 is provided in the reflector 108, the antenna element 110 is inserted into the through-hole 140, and the antenna element 110 penetrates through the reflector 108 may be considered. In this case, the feed line 103 can be extended to the z-axis negative direction side of the reflector 108, which results in an advantage that the RF circuit (not shown) included on the side of the z-axis negative direction of the reflector 108 and the feed line 103 can be easily connected to each other.

Figure 17:
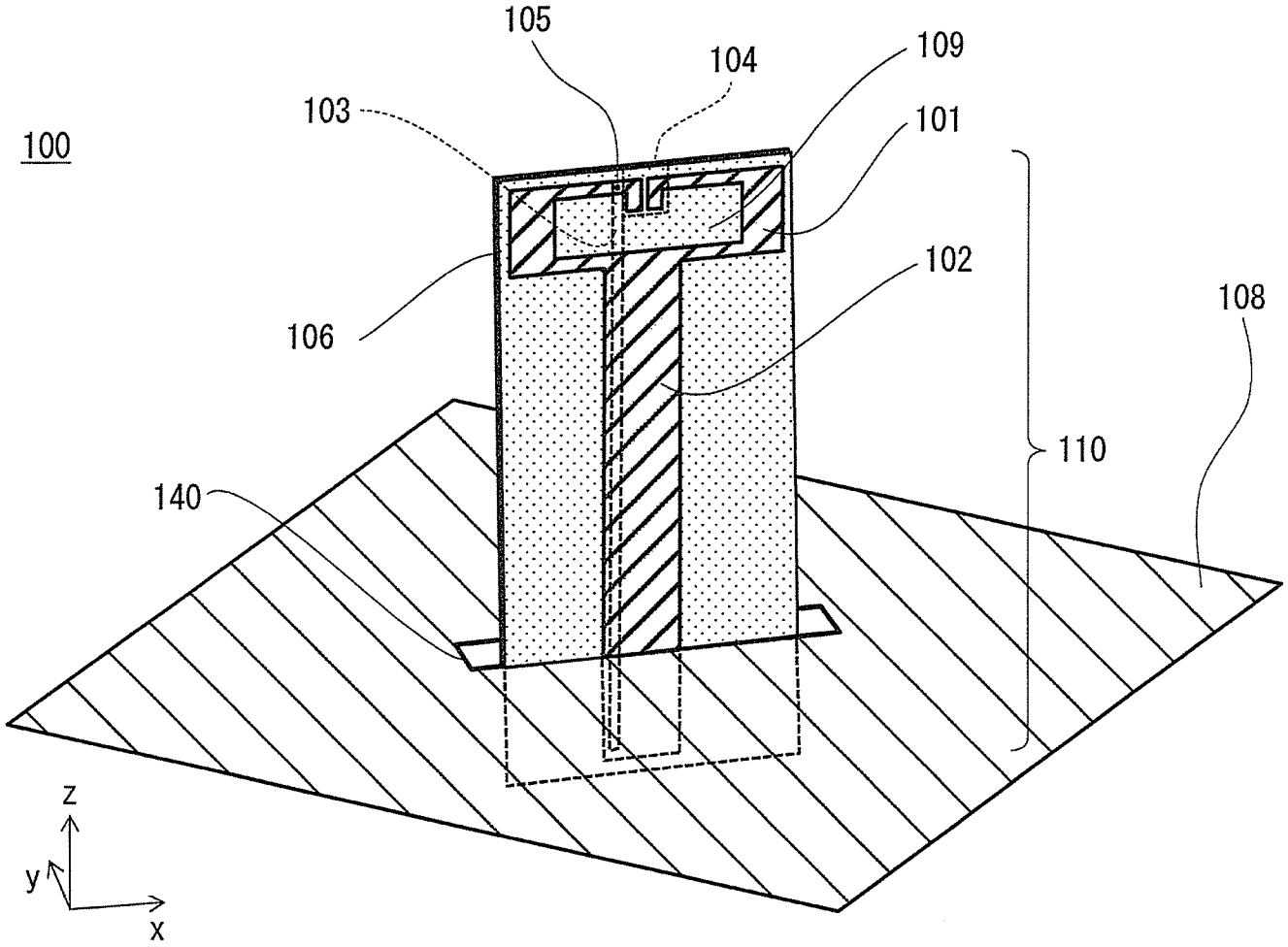
FIG. 17 is a schematic view of another antenna according to the first exemplary embodiment.

Further, as shown in FIG. 17, a structure in which the connection part 102 and the reflector 108 are not electrically connected to each other by making the size of the through-hole 140 larger than that of the cross section of the antenna element 110 on the xy-plane may be employed.

While the structure in which the reflector 108 is provided in the antenna 100 has been described as an example, the reflector 108 may be omitted. In such a case, the electromagnetic waves are radiated in broader directions, whereby it is possible to efficiently form a broader communication area.

Figure 18:
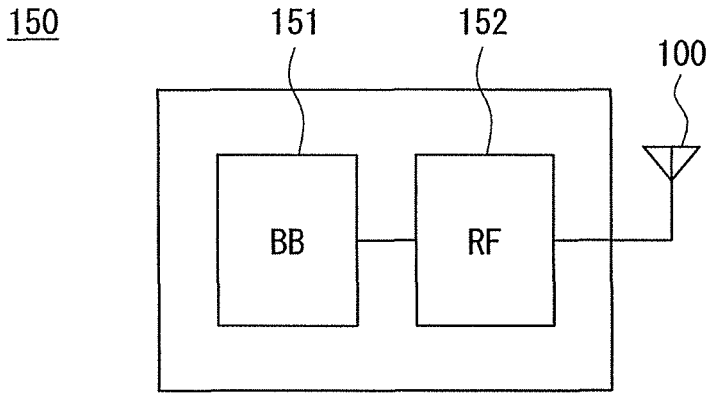
FIG. 18 is a diagram showing a configuration example of a radio communication apparatus including the antenna according to the first exemplary embodiment.

FIG. 18 shows a configuration example of a radio communication apparatus 150 including the antenna 100 according to this exemplary embodiment. The radio communication apparatus 150 includes a baseband circuit 151 that performs signal processing and an RF circuit part 152 that generates an RF signal and is able to perform radio communication by transmitting or receiving the RF signal by the antenna 100. However, the structure of the radio communication apparatus 150 is not limited to the one shown in FIG. 18. The radio communication apparatus 150 may have a structure, for example, in which a plurality of antennas 100, RF circuits 152, and baseband circuits 151 are provided or may have a structure in which a part of the baseband circuit is provided outside the radio communication apparatus 150 and the radio communication apparatus 150 and the part of the baseband circuit provided outside the radio communication apparatus 150 are connected to each other by a cable.

Second Exemplary Embodiment

Figure 19:
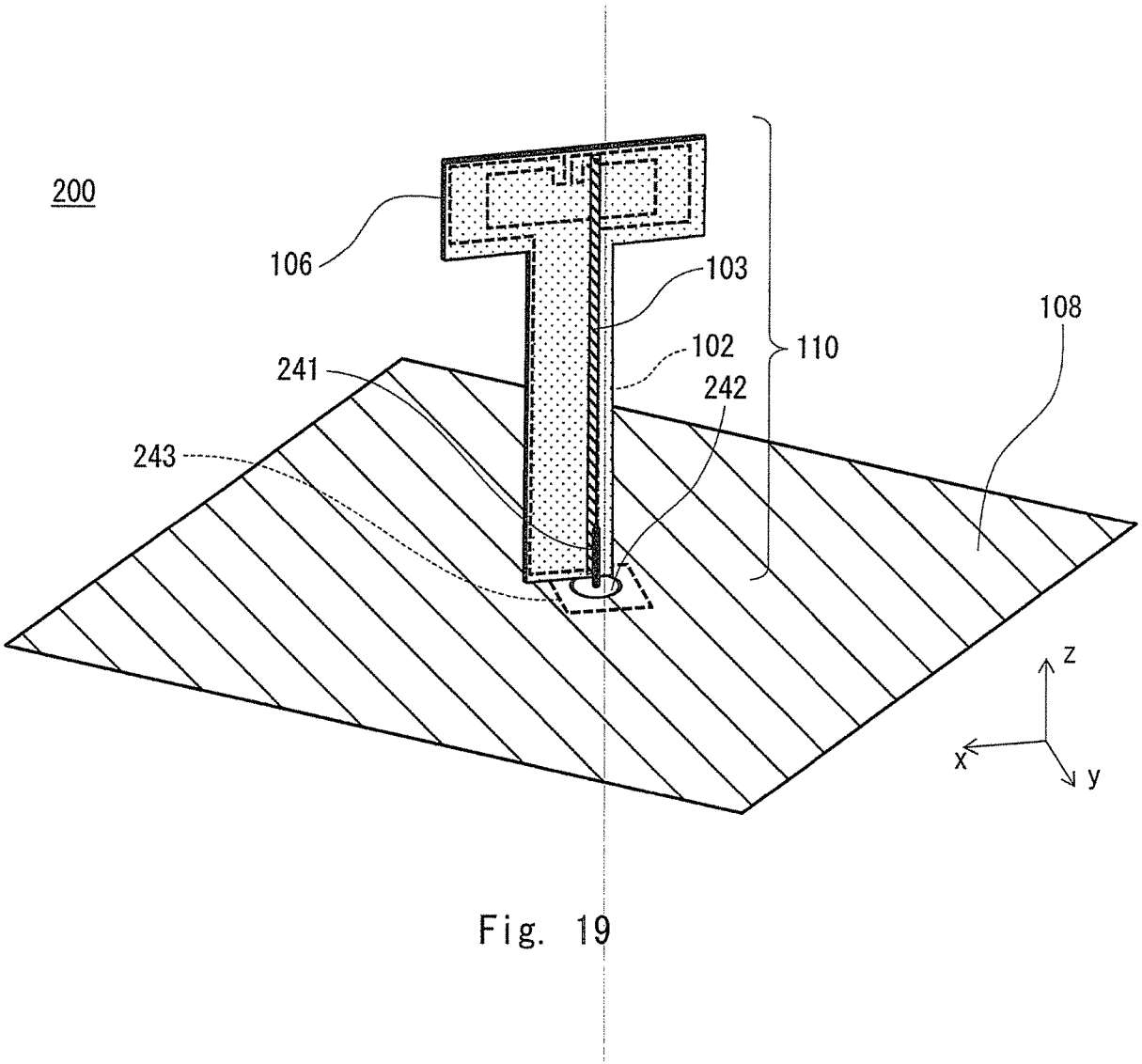
FIG. 19 is a perspective view of an antenna according to a second exemplary embodiment.
Figure 20:
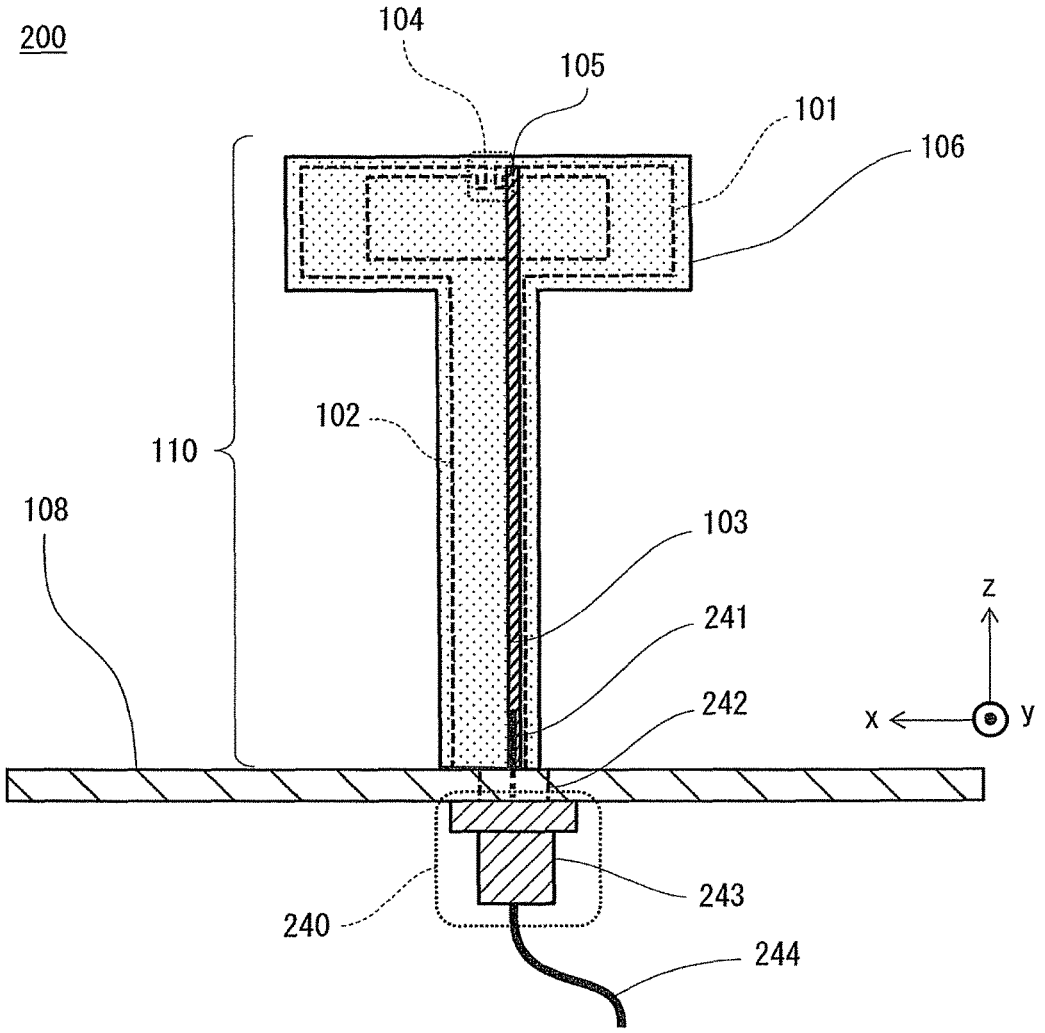
FIG. 20 is a plan view of the antenna shown in FIG. 19 when it is seen from a y-axis positive direction.

FIG. 19 is a perspective view of an antenna 200 according to a second exemplary embodiment of the present invention. FIG. 20 is a plan view of the antenna 200 according to the second exemplary embodiment when it is seen from the y-axis positive direction. As shown in FIGS. 19 and 20, the antenna 200 according to this exemplary embodiment is the same as the antenna according to the first exemplary embodiment except for the following point.

In the antenna 200 shown in FIGS. 19 and 20, a connector 240 is provided on the rear side (on the side of the z-axis negative direction) of the reflector 108. An external conductor 243 of the connector 240 is electrically connected to the reflector 108. A core wire 241 of the connector 240 passes a clearance 242 provided in the reflector 108, penetrates through the reflector 108 and protrudes from the front side of the reflector 108 (side of the z-axis positive direction), and is electrically connected to the feed line 103 of the antenna element 110.

According to the above structure, the antenna 200 according to this exemplary embodiment is able to supply power to the antenna element 110 on the front side of the reflector 108 via a cable 244 and the connector 240 from the RF circuit, a digital circuit and the like arranged on the rear side of the reflector 108, whereby it is possible to configure the radio communication apparatus without significantly changing the radiation pattern and the radiation efficiency.

Third Exemplary Embodiment

Figure 21:
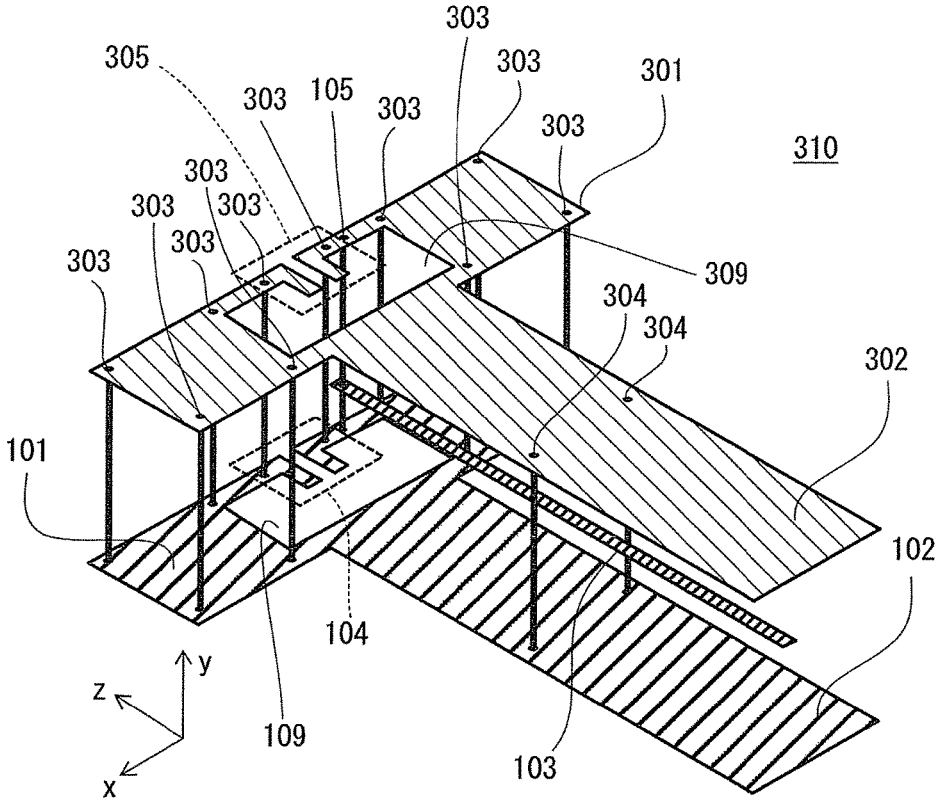
FIG. 21 is a schematic view of an antenna element according to a third exemplary embodiment.

FIG. 21 is a perspective view of an antenna element 310 according to a third exemplary embodiment of the present invention. As shown in FIG. 21, the antenna element 310 according to this exemplary embodiment is the same as the antenna element 110 according to the first exemplary embodiment except for the following point.

The antenna element 310 shown in FIG. 21 includes a second split-ring part 301 and a second connection part 302 in a layer that is different from the layer in which the split-ring part (first split-ring part) 101 and the connection part (first connection part) 102 of the dielectric substrate 106 are arranged and is different from the layer in which the feed line 103 is arranged. The feed line 103 is arranged between the first split-ring part 101 and the first connection part 102, and the second split-ring part 301 and the second connection part 302.

The second connection part 302 is a conductor that extends in the z-axis direction and has one end that is connected to a part near the center of the longer side of the second split-ring part 301 that is close to the reflector 108 (on the side of the z-axis negative direction) and the other end that is connected to the reflector 108. The second connection part 302 electrically connects the second split-ring part 301 and the reflector 108. The first split-ring part 101 and the second split-ring part 301 are electrically connected to each other via a plurality of conductor vias 303 and operate as one split-ring resonator. Further, the first connection part 102 and the second connection part 302 are electrically connected to each other via a plurality of conductor vias 304.

The feed line 103 has one end that is connected to parts on the longer sides of the first split-ring part 101 and the second split-ring part 301 that are far from the reflector 108 (sides of the z-axis positive direction) via the conductor via 105. The feed line 103 spans the opening 109 of the first split-ring part 101 and the opening 309 of the second split-ring part 301 when it is seen from the y-axis direction and extends to an area that is opposed to the first connection part 102 and the second connection part 302.

The feed line 103 is capacitatively coupled to the first connection part 102 and the second connection part 302 and forms the transmission line in an area that is opposed to the first connection part 102 and the second connection part 302. As a result, the RF signal generated by the RF circuit (not shown) is transmitted by the feed line 103 and is supplied to the first split-ring part 101 and the second split-ring part 301.

By using the antenna element 310 according to this exemplary embodiment, the electromagnetic waves transmitted by the feed line 103 can be confined by the first connection part 102 and the second connection part 302, whereby it is possible to reduce unnecessary radiations from the feed line 103.

Figure 22:
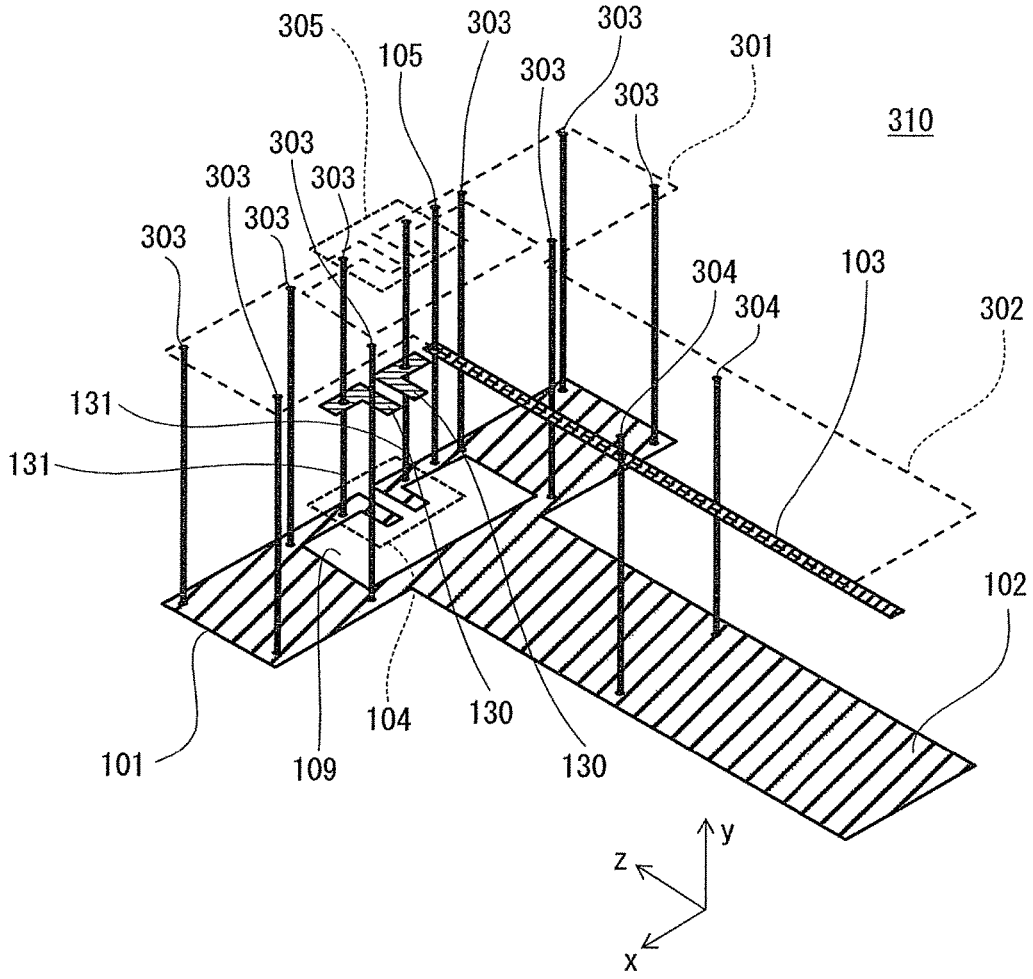
FIG. 22 is a schematic view of another antenna element according to the third exemplary embodiment.

Further, as shown in FIG. 22, similar to FIG. 5 according to the first exemplary embodiment, such a structure in which the auxiliary conductor patterns 130 are provided in a layer different from the layer where the first split-ring part 101 of the dielectric substrate 106 and the second split-ring part 301 are formed and the auxiliary conductor patterns 130 are connected to the split part (first split part) 104 and a second split part 305 via the conductor via 131 may be employed. The area of the conductors that are opposed to each other in the first split part 104 and the second split part 305 increases due to the arrangement of the auxiliary conductor patterns 130, whereby it is possible to increase the capacitance without increasing the size of the resonator as a whole.

Figure 23:
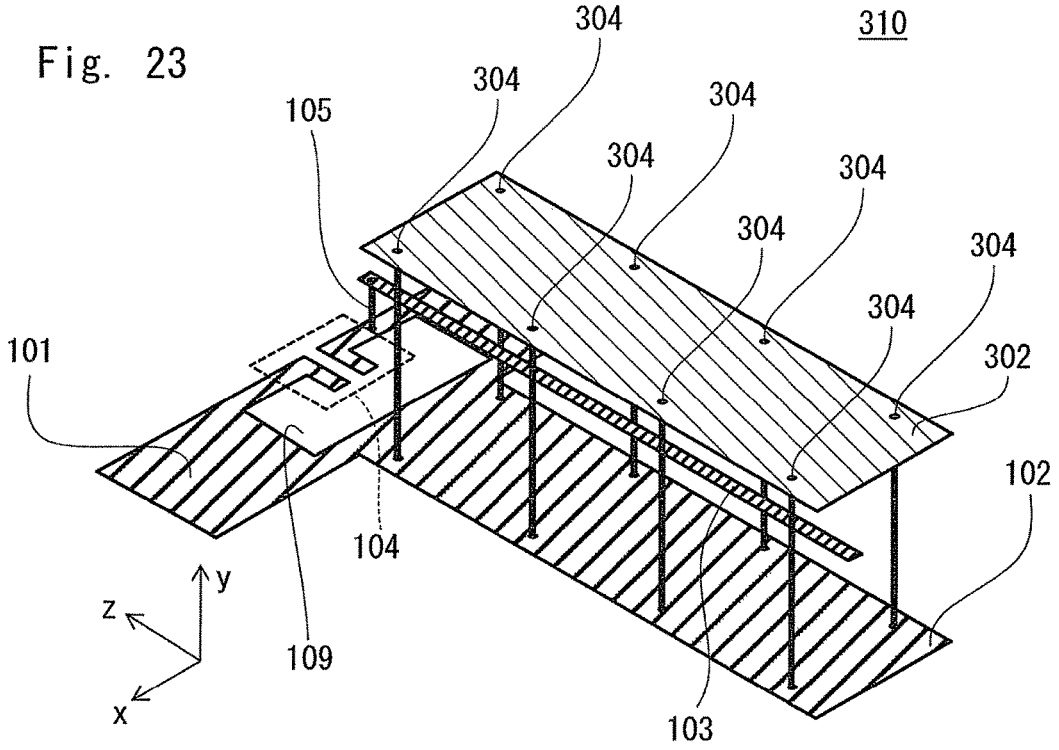
FIG. 23 is a schematic view of another antenna element according to the third exemplary embodiment.

While the structure in which both the second split-ring part 301 and the second connection part 302 are provided has been shown in FIGS. 21 and 22, such a structure in which only one of them is provided may be naturally employed. As shown in FIG. 23, for example, when a structure in which only the second connection part 302 is provided is employed, similar to the structures shown in FIGS. 21 and 22, the electromagnetic waves transmitted by the feed line 103 can be confined by the first connection part 102 and the second connection part 302, whereby it is possible to reduce unnecessary radiations from the feed line 103.

Fourth Exemplary Embodiment

Figure 24:
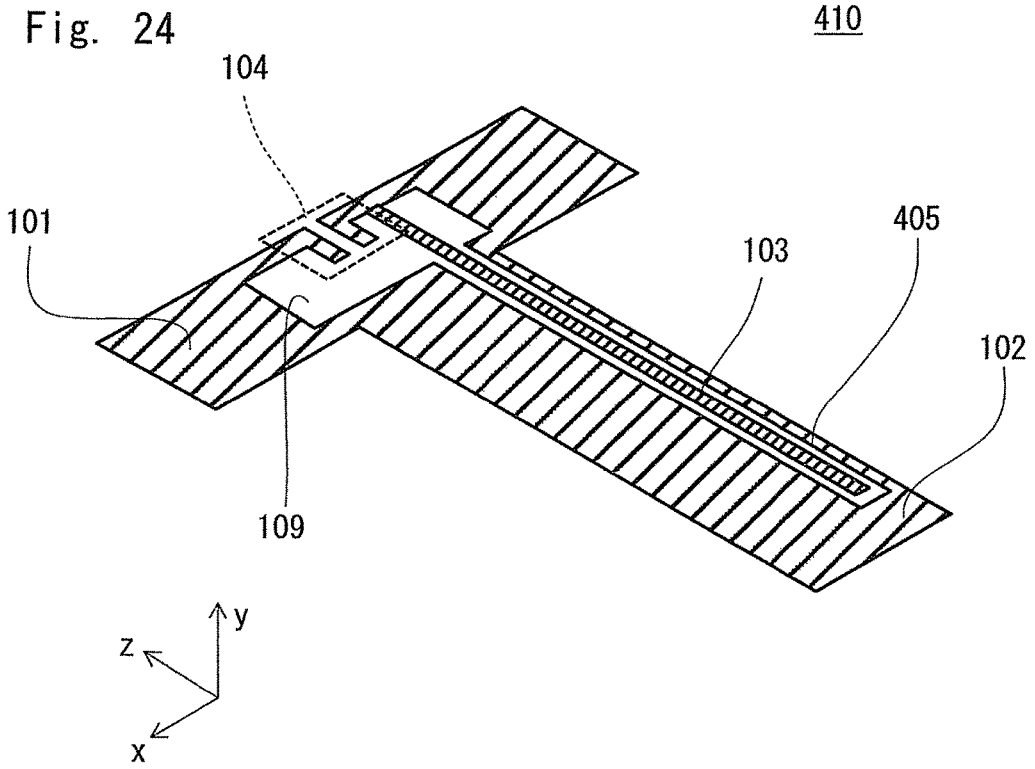
FIG. 24 is a schematic view of an antenna element according to a fourth exemplary embodiment.

FIG. 24 is a perspective view of an antenna element 410 according to a fourth exemplary embodiment of the present invention. As shown in FIG. 24, the antenna element 410 according to this exemplary embodiment is the same as the antenna element according to the first exemplary embodiment except for the following point.

In the antenna element 410 shown in FIG. 24, the split-ring part 101, the connection part 102, and the feed line 103 are formed on one layer of the dielectric substrate 106. In this case, one end of the feed line 103 is connected to a part on the longer side of the split-ring part 101 which is far from the reflector 108 (side of the z-axis positive direction) and the other end thereof extends inside a clearance 405 provided in the split-ring part 101 and the connection part 102 and is connected to an RF circuit (not shown).

The feed line 103 is capacitatively coupled to the connection part 102 to thereby form a transmission line in an area that is opposed to the connection part 102. As a result, the RF signal generated by the RF circuit (not shown) is transmitted by the feed line 103 and is supplied to the split-ring part 101.

The antenna element 410 according to this exemplary embodiment can be operated in a way similar to the antenna element 110 according to the first exemplary embodiment.

Figure 25:
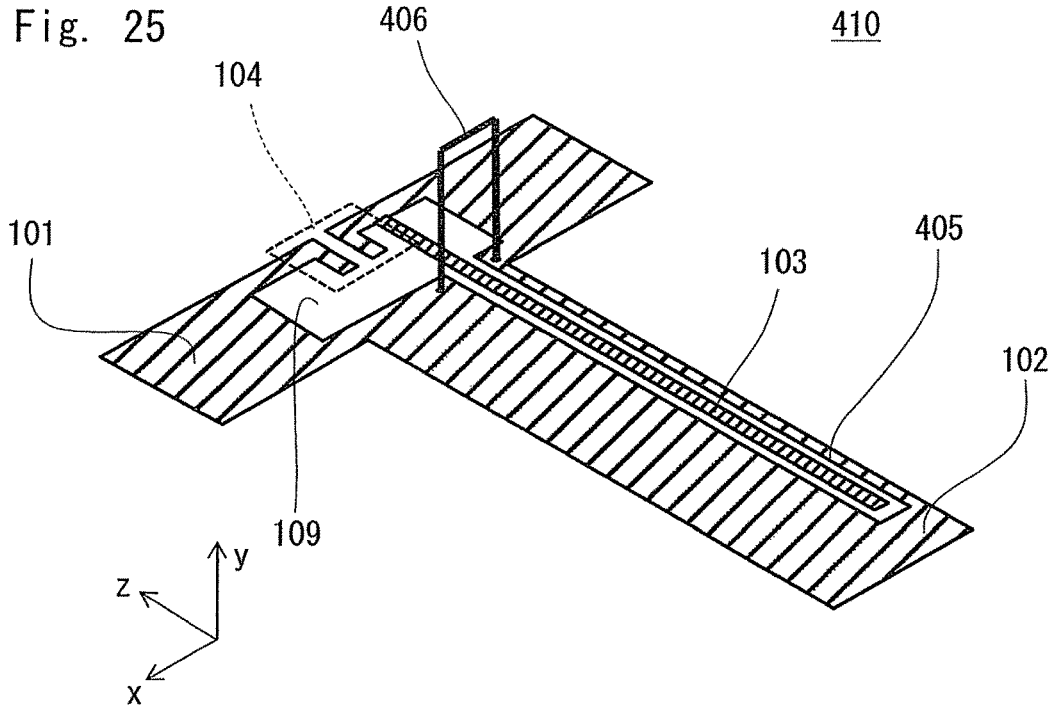
FIG. 25 is a schematic view of another antenna element according to the fourth exemplary embodiment.

Further, as shown in FIG. 25, such a structure in which a bridge conductor 406 that spans the clearance 405 and electrically connects both ends of the split-ring part 101 separated by the clearance 405 may be employed. According to this structure, it is possible to further stabilize the operation of the antenna element 410.

Figure 26:
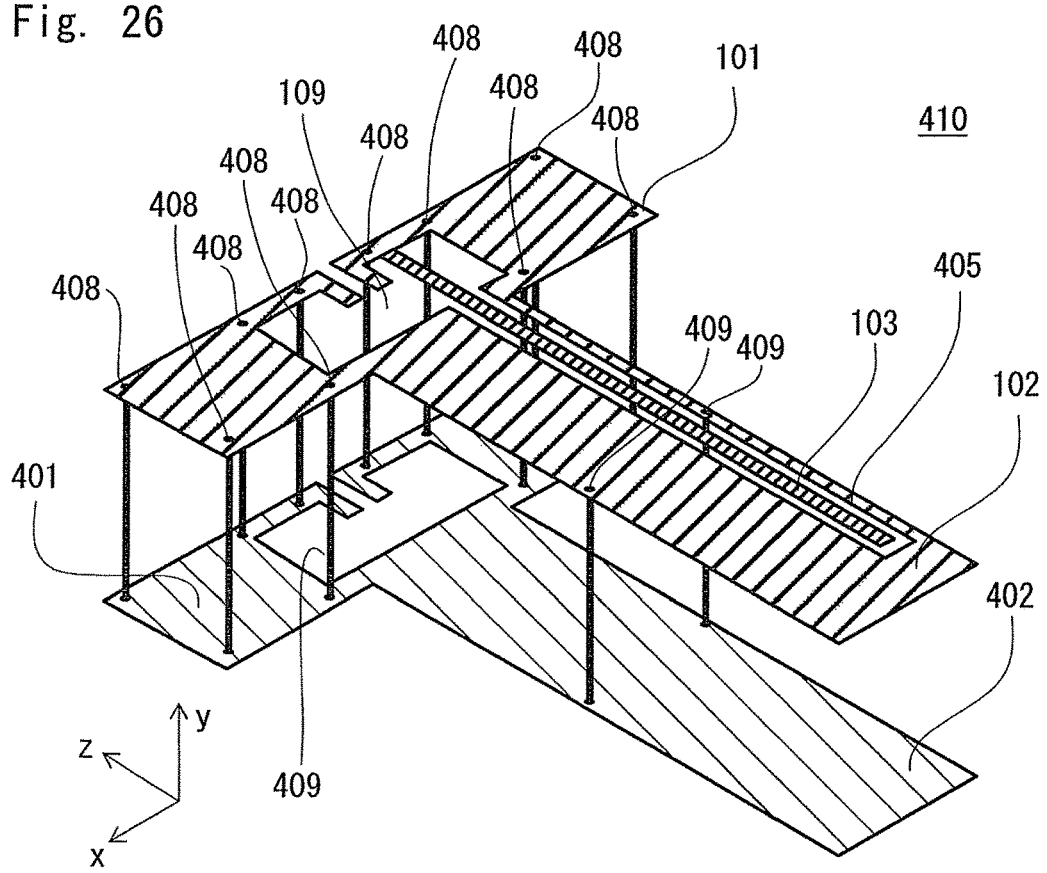
FIG. 26 is a schematic view of another antenna element according to the fourth exemplary embodiment.

Further, as shown in FIG. 26, such a structure in which a second split-ring part 401 and a second connection part 402 are included in a layer different from the layer in which the split-ring part (first split-ring part) 101, the connection part (first connection part) 102, and the feed line 103 of the dielectric substrate 106 are arranged may be employed.

Similar to the third exemplary embodiment, the first split-ring part 101 and the second split-ring part 401 are electrically connected to each other using a plurality of conductor vias 408 and serve as one split-ring resonator. Further, the first connection part 102 and the second connection part 402 are electrically connected to each other using a plurality of conductor vias 409. According to this structure, the antenna element 410 according to the fourth exemplary embodiment can be operated in a way similar to the antenna element 310 according to the third exemplary embodiment.

Fifth Exemplary Embodiment

Figure 27:
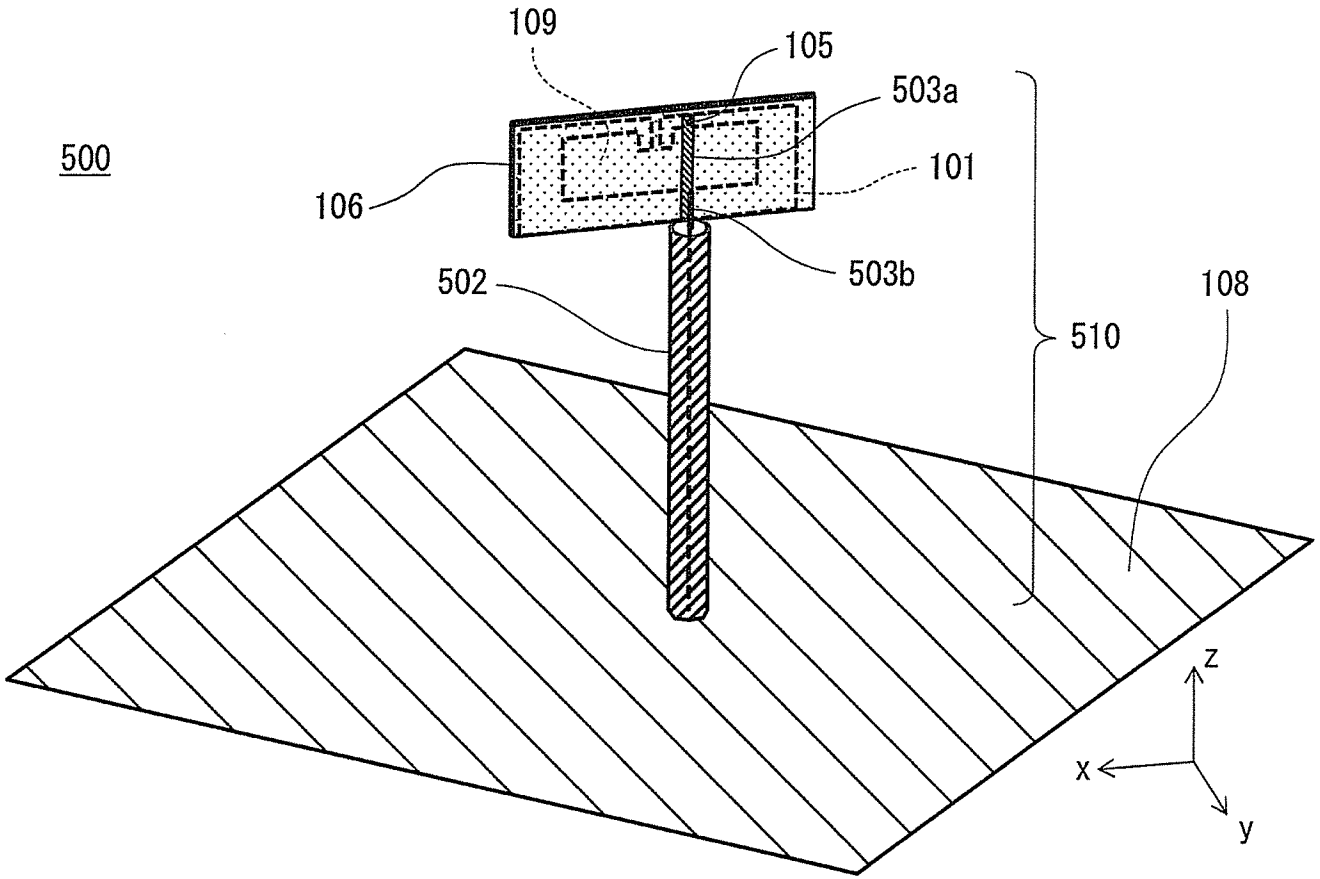
FIG. 27 is a perspective view of an antenna according to a fifth exemplary embodiment.
Figure 28:
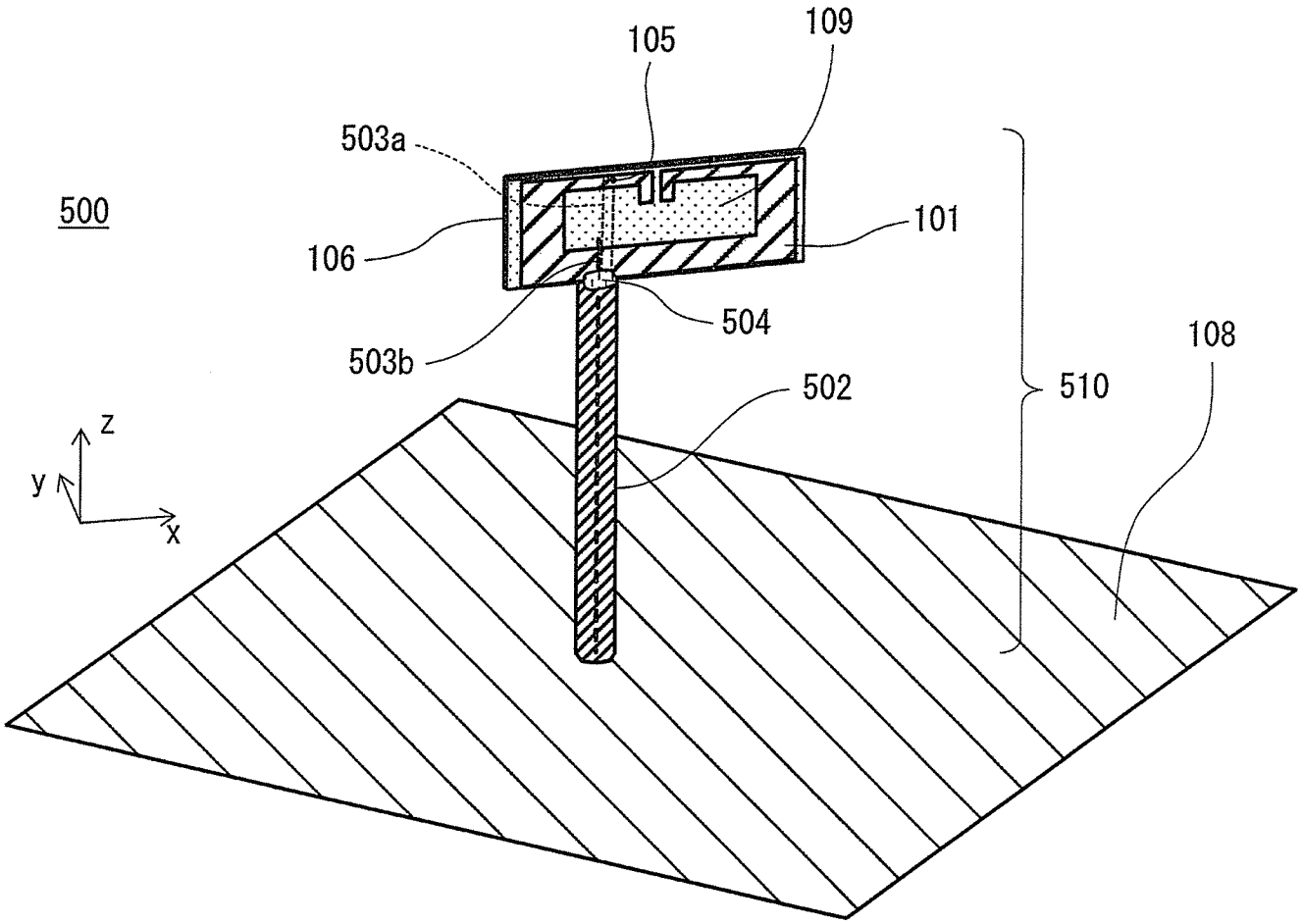
FIG. 28 is another perspective view of the antenna according to the fifth exemplary embodiment.

FIGS. 27 and 28 are perspective views of an antenna 500 according to a fifth exemplary embodiment of the present invention when the antenna 500 is seen from directions different from each other. As shown in FIGS. 27 and 28, the antenna 500 according to this exemplary embodiment is similar to the antenna according to the first exemplary embodiment except for the following points.

The antenna 500 shown in FIG. 27 uses an external conductor 502 of a coaxial cable as the connection part that electrically connects the split-ring part 101 and the reflector 108. The external conductor 502 extends in the z-axis direction and has one end that is electrically connected to an area near the center of the longer side of the split-ring part 101 which is on the side close to the reflector 108 (side of the z-axis negative direction) by a solder 504 and the other end that is connected to the reflector 108. The external conductor 502 electrically connects the split-ring part 101 and the reflector 108.

The feed line 503*a* is a linear conductor and has one end connected to a part on the longer side of the split-ring part 101 which is on the side far from the reflector 108 (side of the z-axis positive direction) via the conductor via 105. The feed line 503*a* spans the opening 109 of the split-ring part 101 when it is seen from the y-axis direction and is connected to a core wire 503*b* of the coaxial cable. The other end of the core wire 503*b* is connected to an RF circuit (not shown). According to this structure, the feed line 503*a* and the core wire 503*b* are able to operate in a way similar to the feed line 103 according to the first exemplary embodiment, and the RF signal generated by the RF circuit may be supplied to the split-ring part 101.

While the structure in which the external conductor 502 and the split-ring part 101 are electrically connected to each other by the solder 504 has been described as one example, any connection method may be employed as long as the external conductor 502 and the split-ring part 101 are electrically connected to each other.

By using the antenna 500 according to this exemplary embodiment, the electromagnetic waves transmitted by the core wire 503*b* can be confined by the external conductor 502, whereby it is possible to reduce unnecessary radiations from the core wire 503*b*.

Figure 29:
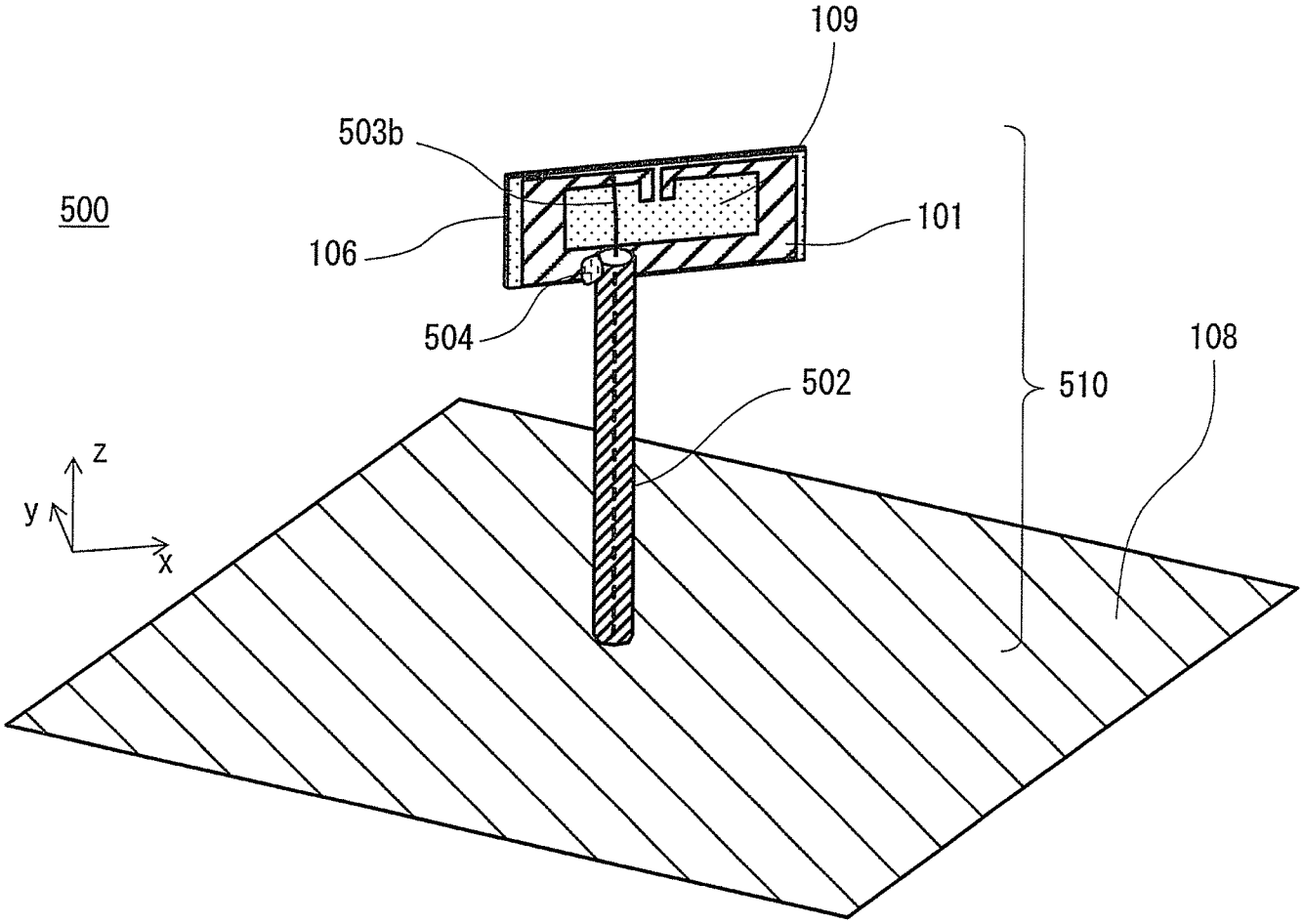
FIG. 29 is a perspective view of another antenna according to the fifth exemplary embodiment.

Further, as shown in FIG. 29, such a structure in which the core wire 503*b* is directly connected to a part on the longer side of the split-ring part 101 which is far from the reflector 108 (side of the z-axis positive direction) without using the feed line 503*a* may be employed.

Figure 30:
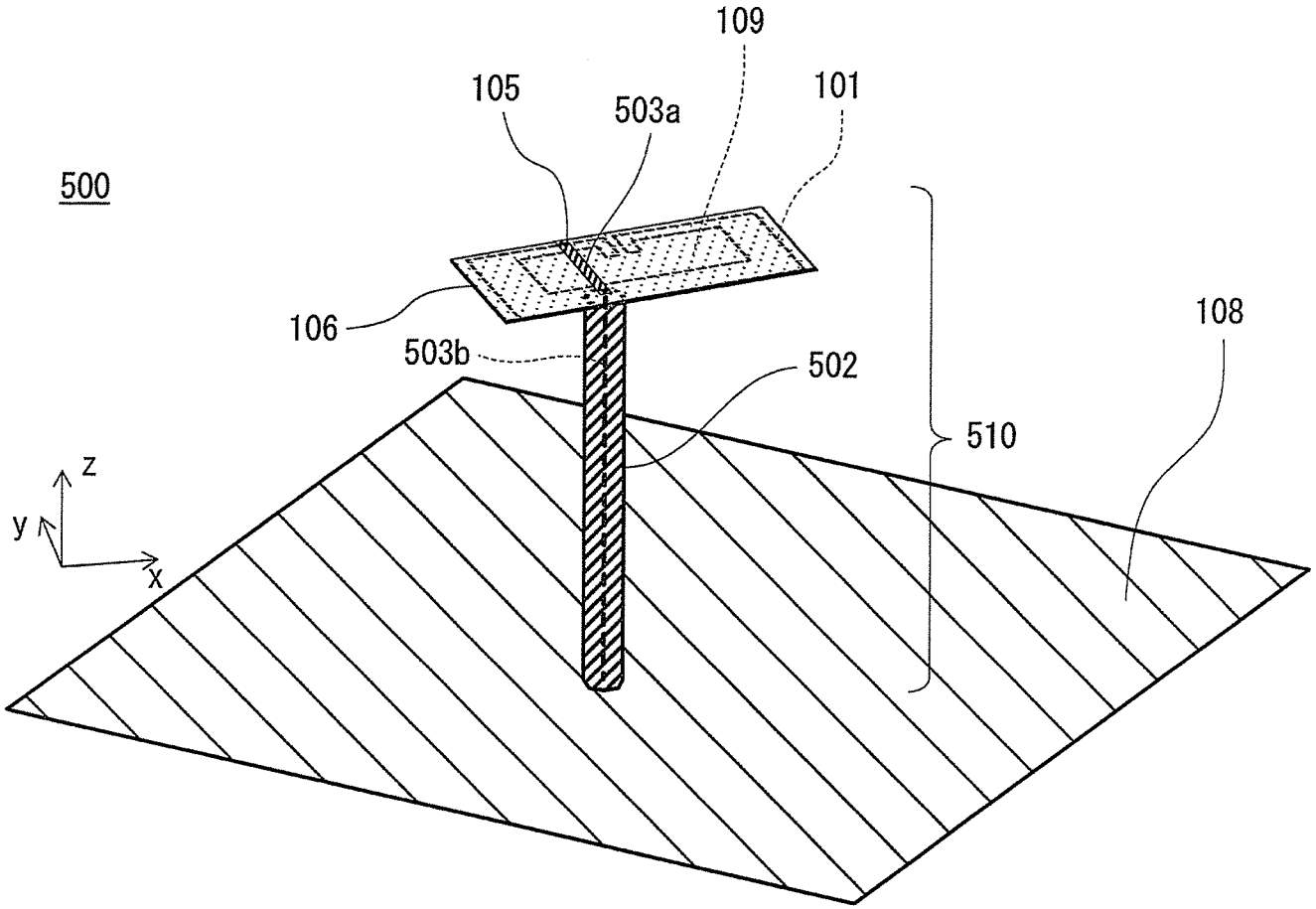
FIG. 30 is a perspective view of another antenna according to the fifth exemplary embodiment.

Further, as shown in FIG. 30, such a structure in which the dielectric substrate 106 including the split-ring part 101, the feed line 503*a*, and the conductor via 105 is arranged in parallel with the xy-plane may be employed.

Sixth Exemplary Embodiment

Figure 31:
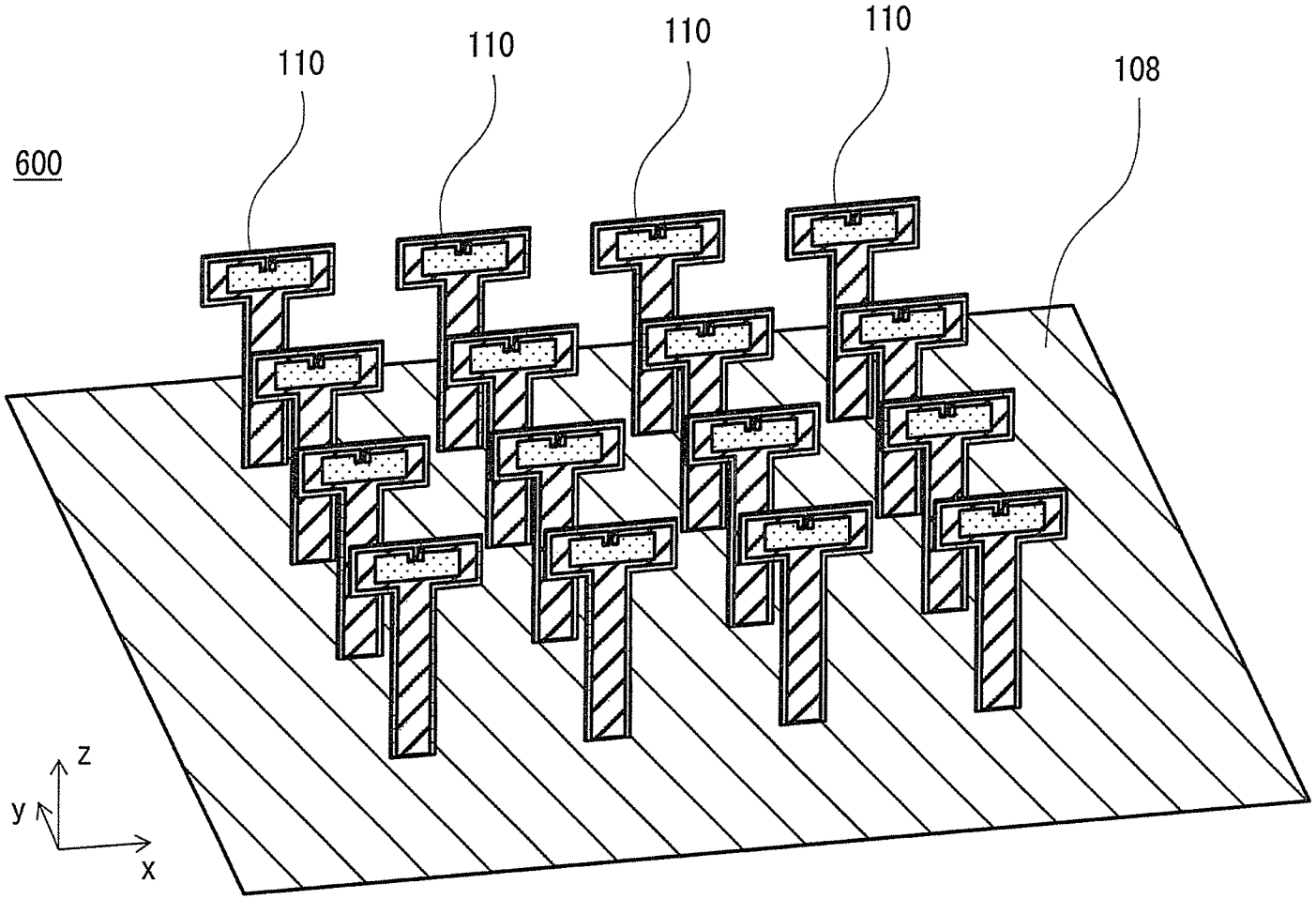
FIG. 31 is a perspective view of an array antenna according to a sixth exemplary embodiment.

FIG. 31 is a perspective view of an array antenna 600 according to a sixth exemplary embodiment of the present invention. As shown in FIG. 31, the array antenna 600 according to this exemplary embodiment is based on the first exemplary embodiment and includes a plurality of antenna elements 110 according to the first exemplary embodiment.

The array antenna 600 according to this exemplary embodiment has a structure in which the antenna elements 110 according to the first exemplary embodiment are arranged in one-dimensional or two-dimensional arrays at constant intervals on one reflector 108. The connection parts 102 of the respective antenna elements 110 are electrically connected to the reflector 108 and the respective feed lines 103 are connected to an RF circuit (not shown).

According to the array antenna 600 according to this exemplary embodiment, by inputting RF signals whose phases are different from one another to the respective antenna elements 110, beam forming can be performed in a desired direction.

Figure 32:
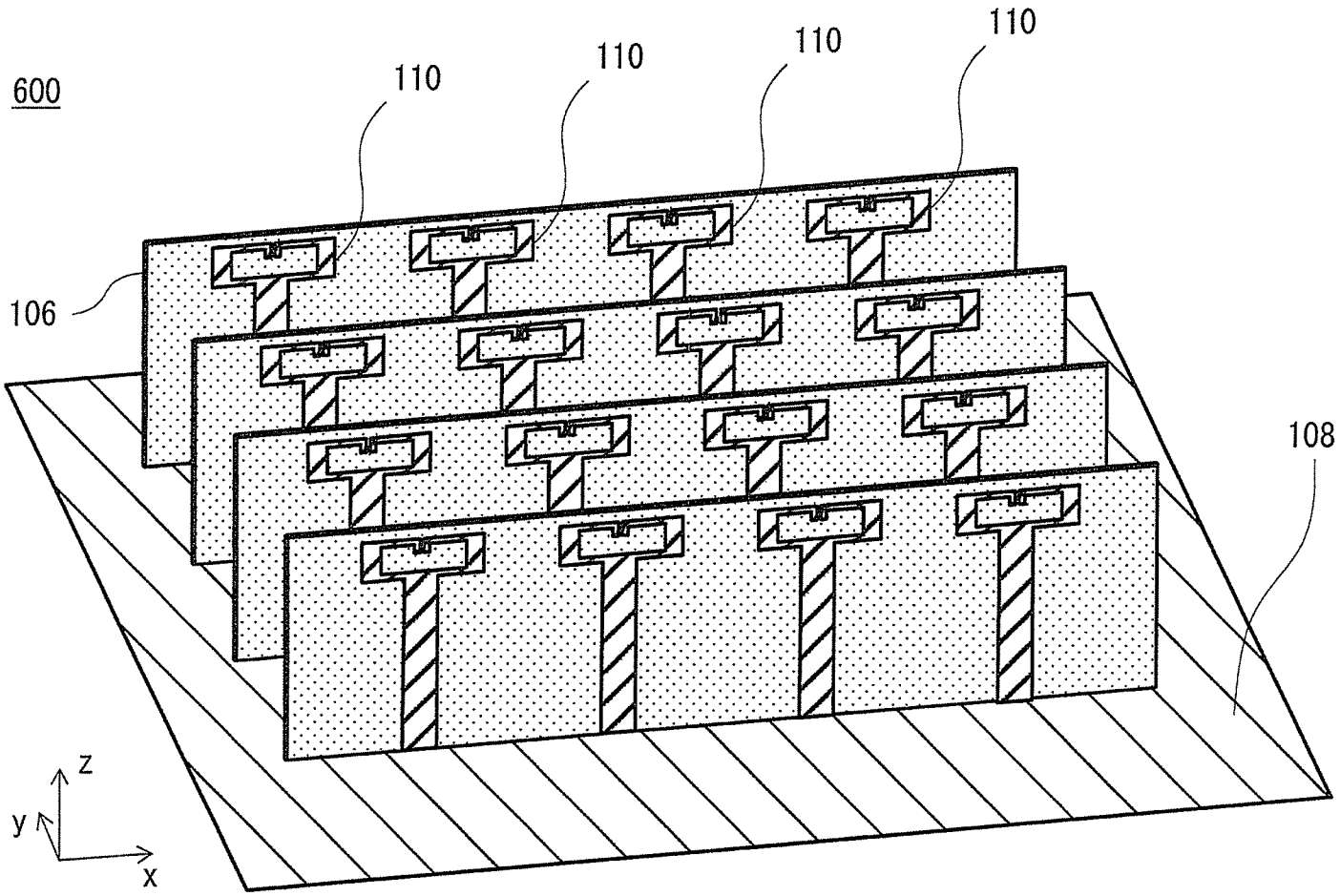
FIG. 32 is a perspective view of another array antenna according to the sixth exemplary embodiment.

Further, as shown in FIG. 32, a structure in which a plurality of antenna elements 110 that compose the array antenna 600 are arranged in one dielectric substrate 106 for each line may be employed. According to such a structure, the number of processes for aligning the antenna elements 110 can be reduced, whereby it is possible to easily assemble the array antenna 600.

Figure 33:
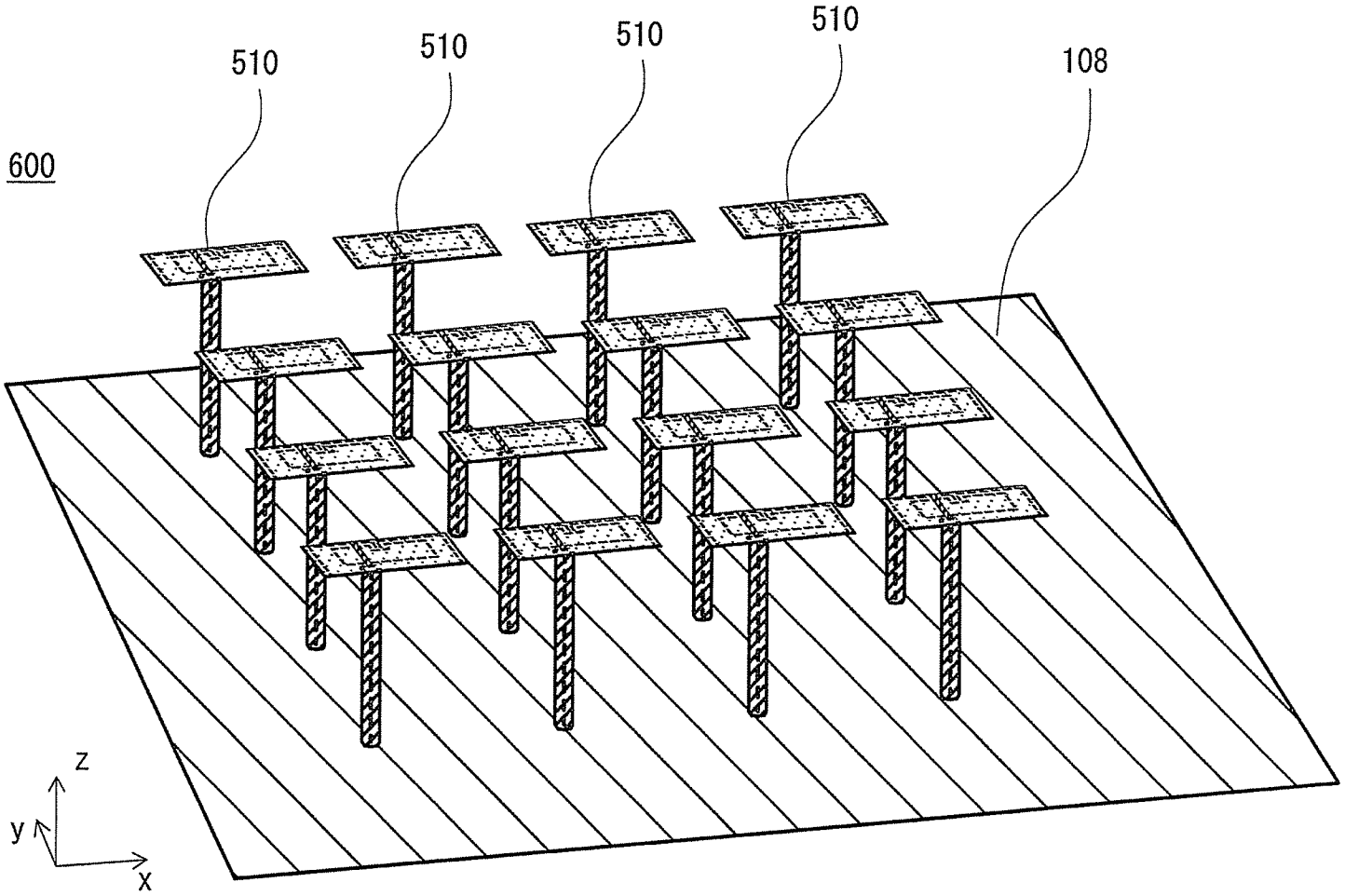
FIG. 33 is a perspective view of another array antenna according to the sixth exemplary embodiment.
Figure 34:
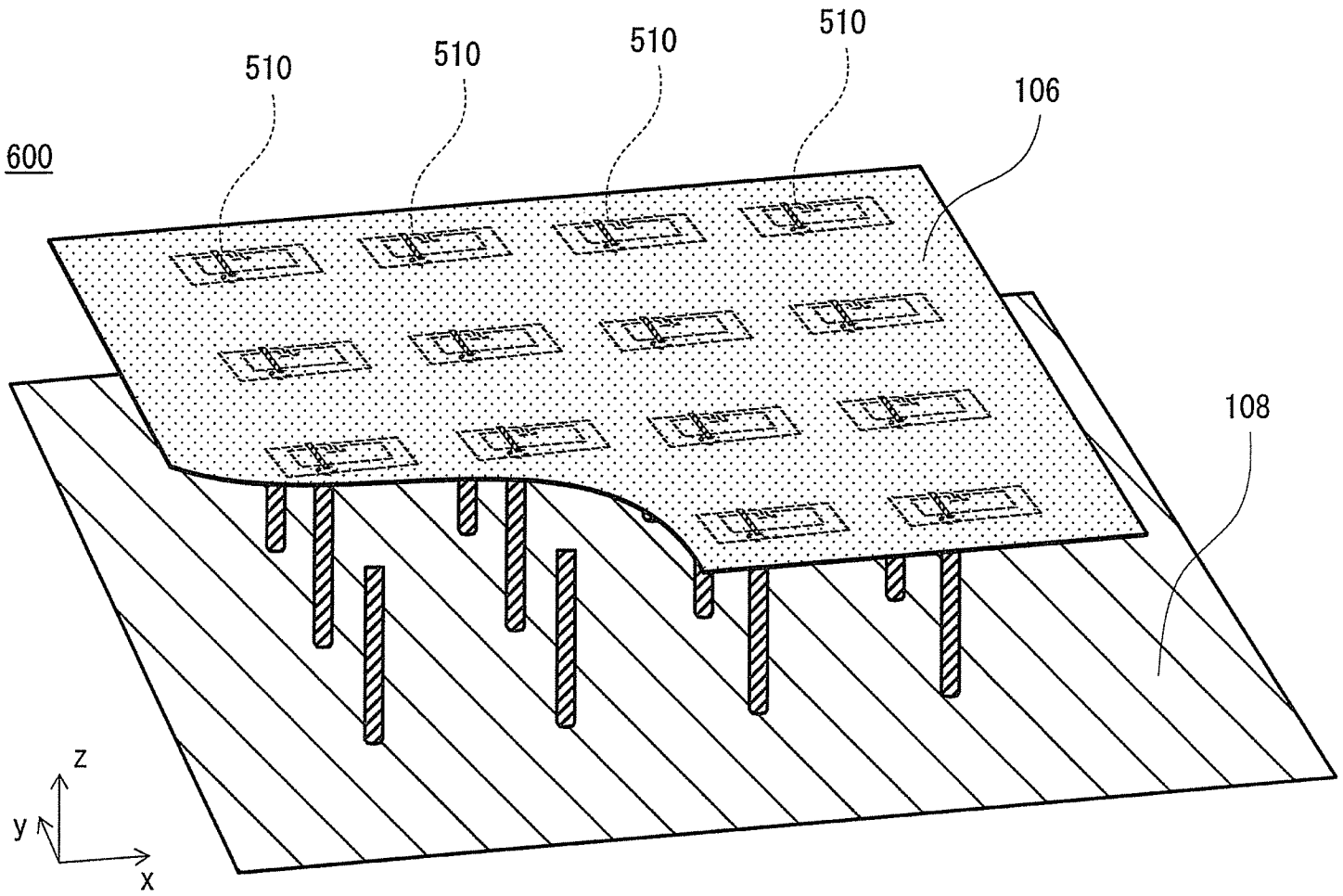
FIG. 34 is a perspective view of another array antenna according to the sixth exemplary embodiment.

While the example based on the first exemplary embodiment has been described here, a configuration based on the other exemplary embodiments can of course also be employed. As shown in FIG. 33, for example, antenna elements 510 according to the fifth exemplary embodiment may be arranged in array. Further, as shown in FIG. 34, a plurality of split-ring parts 101 may be arranged in one dielectric substrate 106. According to such a structure, the number of processes for aligning the antenna elements 510 can be reduced, whereby it is possible to easily assemble the array antenna 600.

Naturally, the foregoing exemplary embodiments and the plurality of modified examples can be combined within a scope in which the contents thereof do not conflict with one another. Furthermore, in the foregoing exemplary embodiments and the modified examples, the functions and the like of the respective components have been described in detail. The functions thereof may be changed to any type within a scope that satisfies the present invention.

While the present invention has been described with reference to the exemplary embodiments, the present invention is not limited to the above exemplary embodiments. Various changes that can be understood by those skilled in the art may be made on the configuration and the details of the present invention within the scope of the present invention.

This application is based upon and claims the benefit of priority from Japanese Patent Application No. 2014-73196, filed on Mar. 31, 2014, the disclosure of which is incorporated herein in its entirety by reference.

REFERENCE SIGNS LIST

100 ANTENNA
101 SPLIT-RING PART (FIRST SPLIT-RING PART)
102 CONNECTION PART (FIRST CONNECTION PART)
103 FEED LINE
104 SPLIT PART (FIRST SPLIT PART)
105 CONDUCTOR VIA
106 DIELECTRIC SUBSTRATE
108 REFLECTOR
109 OPENING
110 ANTENNA ELEMENT

120 RADIATION PART
130 AUXILIARY CONDUCTOR PATTERN
131 CONDUCTOR VIA
150 RADIO COMMUNICATION APPARATUS
151 BASEBAND CIRCUIT
152 RF CIRCUIT PART
200 ANTENNA
240 CONNECTOR
241 CORE WIRE
242 CLEARANCE
243 EXTERNAL CONDUCTOR
244 CABLE
301 SECOND SPLIT-RING PART
302 SECOND CONNECTION PART
303, 304 CONDUCTOR VIA
305 SECOND SPLIT PART
309 OPENING
310 ANTENNA ELEMENT
401 SECOND SPLIT-RING PART
402 SECOND CONNECTION PART
405 CLEARANCE
406 BRIDGE CONDUCTOR
408, 409 CONDUCTOR VIA
410 ANTENNA ELEMENT
500 ANTENNA
502 EXTERNAL CONDUCTOR
503*a* FEED LINE
503*b* CORE WIRE
600 ARRAY ANTENNA

The invention claimed is:

1. An antenna comprising:
at least one antenna element; and
a reflecting conductive plane, wherein:
the antenna element comprises:
a first Split Ring Resonator;
a first conductor; and
a feed line, wherein
the first Split Ring Resonator is practically perpendicular to the reflecting conductive plane,
the first conductor is:
elongated-plate-shaped or tube-shaped, and practically perpendicular to the reflecting conductive plane,
a first end of the first conductor is:
electrically connected to the first Split Ring Resonator,
a second end of the first conductor is:
electrically connected to the reflecting conductive plane, or
disposed on a side opposite to the first end of the first conductor with the reflecting conductive plane in between as the first conductor passes through the reflecting conductive plane,
a first end of the feed line is:
electrically connected to the first Split Ring Resonator, and
the feed line is:
across an opening of the first Split Ring Resonator.

2. The antenna according to claim 1, wherein
the first Split Ring Resonator comprises:
a long side in a direction practically parallel to the reflecting conductive plane, and
a connection part between the first Split Ring Resonator and the first end of the first conductor is:
disposed within a range of ¼ length of the long side from a center of the long side to both end of the long side.

3. The antenna according to claim 1, wherein
the feed line passes through the reflecting conductive plane.

4. The antenna according to claim 1, wherein
the first Split Ring Resonator, the first conductor, and the feed line are:
disposed in the same layer,
the feed line is:
disposed inside a clearance of the first Split Ring Resonator and the first conductor, and
portions of the first Split Ring Resonator on either side of a split of the first Split Ring Resonator are:
electrically connected via a conductive bridge.

5. The antenna according to claim 1, wherein
the first Split Ring Resonator and the first conductor are:
disposed in a first layer,
the feed line and a supplementary conductor are:
electrically connected, and
disposed in a second layer.

6. The antenna according to claim 1, wherein
the first Split Ring Resonator and the first conductor are:
disposed in a first layer,
a second Split Ring Resonator electrically connected to the first Split Ring Resonator is:
disposed in a third layer, and
the feed line and a supplementary conductor are:
disposed between the first layer and the third layer.

7. The antenna according to claim 1, wherein
the first Split Ring Resonator and the first conductor are:
disposed in a first layer,
at least one of a second Split Ring Resonator electrically connected to the first Split Ring Resonator or a second conductor electrically connected to the first conductor is:
disposed in a third layer, and
the feed line is:
disposed between the first layer and the third layer.

8. The antenna according to claim 1, wherein
the first conductor is a tube-shaped part of a coaxial cable, and
the feed line is a core part of the coaxial cable.

9. The antenna according to claim 1, comprising:
a plurality of the antenna elements arranged in array.

10. A communication device comprising:
the antenna according to claim 1.

* * * * *